US008826703B2

(12) United States Patent
Lai

(10) Patent No.: US 8,826,703 B2
(45) Date of Patent: Sep. 9, 2014

(54) HIGH SECURITY COMBINATION DISC PADLOCK

(71) Applicant: The Sun Lock Company, Ltd., Tuen Mun (HK)

(72) Inventor: Karl Lai, Hong Kong (HK)

(73) Assignee: The Sun Lock Company Ltd., Tuen Mun, NT, Hong Kong (HK)

( * ) Notice: Subject to any disclaimer, the term of this patent is extended or adjusted under 35 U.S.C. 154(b) by 0 days.

(21) Appl. No.: 13/731,277

(22) Filed: Dec. 31, 2012

(65) Prior Publication Data

US 2013/0205844 A1 Aug. 15, 2013

Related U.S. Application Data

(60) Provisional application No. 61/596,881, filed on Feb. 9, 2012, provisional application No. 61/604,614, filed on Feb. 29, 2012, provisional application No. 61/650,184, filed on May 22, 2012.

(51) Int. Cl.

| | |
|---|---|
| ***E05B 37/02*** | (2006.01) |
| ***E05B 67/28*** | (2006.01) |
| ***E05B 37/00*** | (2006.01) |

(52) U.S. Cl.

CPC ..... *E05B 37/0068* (2013.01); *E05B 37/025* (2013.01); *E05B 67/28* (2013.01); *E05B 37/0048* (2013.01)

USPC ..... 70/22; 70/25

(58) Field of Classification Search

USPC ..... 70/22, 24, 25, 27, 28, 29

See application file for complete search history.

(56) References Cited

U.S. PATENT DOCUMENTS

| | | | | |
|---|---|---|---|---|
| 255,164 | A * | 3/1882 | Grout | 70/25 |
| 596,596 | A | 1/1898 | Johnson | |
| 1,172,970 | A * | 2/1916 | Fowler | 70/27 |
| 1,571,281 | A * | 2/1926 | La Port | 70/25 |
| 3,260,079 | A | 7/1966 | Caskey | |
| 5,109,684 | A * | 5/1992 | Grandy, Sr. | 70/25 |
| 5,765,409 | A * | 6/1998 | Yang | 70/28 |
| 5,782,113 | A * | 7/1998 | Chen | 70/28 |
| 5,901,587 | A * | 5/1999 | Chen | 70/28 |
| 6,029,481 | A | 2/2000 | Lai | 70/25 |
| 6,305,198 | B1 * | 10/2001 | Chastain et al. | 70/40 |
| 7,254,971 | B2 * | 8/2007 | Ruan | 70/25 |
| 7,415,850 | B2 * | 8/2008 | Smyczek et al. | 70/51 |
| 8,393,186 | B2 * | 3/2013 | Schmidt et al. | 70/22 |
| 2007/0056333 | A1 * | 3/2007 | Ruan | 70/25 |
| 2011/0079055 | A1 | 4/2011 | Schmidt et al. | 70/25 |

FOREIGN PATENT DOCUMENTS

WO 2011/044021 A 4/2011

* cited by examiner

*Primary Examiner* — Christopher Boswell

(74) *Attorney, Agent, or Firm* — Ware, Fressola, Maguire & Barber LLP

(57) ABSTRACT

The present invention is directed to exemplary embodiments of a combination disc padlock that may include a housing, a shackle positioned within a portion of the housing, the shackle having a curved shape with a first end that is never released from the housing and a second end that may be exposed from the housing when the padlock is in an unlocked configuration. The padlock may include a mechanism or other structure formed on or connected to the shackle that facilitates movement of the shackle between a closed position and an open position. The padlock may include a reset mechanism that prevents a user from accidentally changing a combination code of the padlock when the padlock is in the unlocked configuration, thereby requiring that the padlock be put into a reset mode in order to change the combination code.

11 Claims, 20 Drawing Sheets

HIGH SECURITY COMBINATION DISC PADLOCK

CROSS-REFERENCE TO RELATED APPLICATIONS

This application claims priority to U.S. Provisional Appl. No. 61/596,881 filed Feb. 9, 2012, U.S. Provisional Appl. No. 61/604,614 filed Feb. 29, 2012 and U.S. Provisional Appl. No. 61/650,184 filed May 22, 2012, all of which are hereby incorporated by reference in their entireties.

FIELD OF THE INVENTION

This invention relates to locks and more particularly to disc type padlocks.

DESCRIPTION OF RELATED ART

Disc type padlocks are well-known in the art. Disc type padlocks generally have a disc shape with the shackle forming part of the outer periphery of the disc and movable between a locked (closed) position and an unlocked (opened) position. Some of these padlocks have been developed as a combination padlock; that is, a padlock that can be unlocked (opened) with a combination code entered on the padlock.

An exemplary combination disc padlock is disclosed in U.S. Appl. Publ. No. 2011/0079055 entitled Combination Discus Lock Assembly and Methods of Using the Same, which is hereby incorporated by reference in its entirety. This type of combination disc padlock requires the use of a large actuator which can be easily broken by an intruder. Furthermore, the combination code changing technique is complex in nature and therefore would pose difficulty for many people using the lock to change the combination associated therewith.

SUMMARY OF THE INVENTION

The present invention is designed to overcome the above noted limitations that are attendant upon the use of conventional padlocks and, toward this end, it contemplates the provision of a novel combination disc padlock that contains a deadbolt locking mechanism which increases the durability and locking strength of the padlock.

In particular, exemplary embodiments of the combination disc padlock of the present invention may contain a combination mechanism which is similar to that disclosed in U.S. Pat. No. 6,029,481, which is incorporated by reference in its entirety herein.

As will be discussed below, an feature of the present invention is that an actuating mechanism, such as a button (sometimes called a shackle button), that may be used to manually move the shackle between the closed and opened positions is not connected to the locking mechanism itself, but rather the actuating mechanism is only connected to the shackle. Thus, the shackle is the only part that is connected to the locking mechanism which increases the locking strength of the padlock. Thus, if an intruder tries to break the lock via the actuating mechanism, the locking mechanism will not be damaged and the shackle will remain in the locked position.

Accordingly, a combination disc padlock according to the present invention may include a housing, a shackle positioned within a portion of the housing, the shackle having a curved shape with a first end that is never exposed from the housing and a second end which is exposed from the housing when the padlock is in an unlocked state, a combination code core locking mechanism containing a lock body, a spindle, clutches, dials and a locking ball, the lock body having a locked state and an unlocked state, and a button portion connected to the shackle, the button portion having a button portion protrusion dimensioned for allowing the user to turn the shackle as the button portion of the shackle is turned. A second embodiment without a button portion has a gripping area on the shackle to allow movement of the shackle when the padlock is in an unlocked state. A third embodiment has a shackle with an extended projection that extends through a slot in the radial perimeter of the housing, the extended projection configured to allow a user to turn the shackle when the lock body is in an unlocked state. A fourth embodiment has a reset mechanism that prevents the user from accidentally changing the combination code of the padlock when the padlock is in the unlock mode; requiring that the padlock be put into a reset mode in order to change the combination code.

In a first embodiment of the present invention, a user aligns the dials forming the combination lock into the lock open combination code. The user can then swing the shackle button clockwise to open the shackle to a fully opened position. While the button is maintained in the lock open position, the user is able to turn the dials of the combination lock in order to change the combination, if desired. In this manner, the user can easily reset the combination to a new code. After resetting the combination code to a new code, the user can swing the shackle button counterclockwise to close the shackle (put the lock in the locked position). In fact, there is no extra button required to be used by the user before setting the new combination.

Another embodiment of the present invention does not use a shackle button, but rather has a gripping area on the shackle which allows the user to move the shackle between the locked and unlocked positions. Without the button, this padlock embodiment eliminates another area of the padlock from tampering by an intruder.

In a still further embodiment of the present invention, instead of a shackle button or a gripping area on the shackle to move the shackle, an extended protrusion is provided that is movable in a slot area. Thus, when the dials of the combination lock are aligned with the correct lock open code, the user can turn the shackle via the extended projection. The shackle thus turns in the same manner until the extended projection contacts an end wall of the lock housing. The combination code core mechanism of this embodiment is the same as that of the previously described embodiments.

According to another exemplary embodiment of the present invention, a combination disc padlock is provided that may include a housing, a shackle positioned within a portion of the housing and movable between an open position and a closed position, the shackle having a curved shape with a first end positioned within the housing and a second end which can be exposed from the housing when the combination disc padlock is in an unlocked configuration and the shackle is in the open position, and a combination code core locking mechanism comprising a lock body, a spindle positioned within the lock body, at least one clutch positioned concentrically with the spindle, at least one dial operatively engaged with each of the at least one clutches, and a locking ball operatively connected to the spindle. The combination code core locking mechanism is configured to operate the combination disc padlock between the unlocked configuration and a locked configuration, and configured to control movement of the shackle between the open position and the closed position.

In accordance with an exemplary embodiment of the present invention, the combination disc padlock may also include an actuation mechanism operatively coupled to the shackle, and configured to permit movement of the shackle between the open position and the closed position when the combination disc padlock is in the unlocked configuration.

In accordance with an exemplary embodiment of the present invention, the actuation mechanism comprises a button portion operatively connected to the shackle and comprising a button portion protrusion configured to facilitate operation of the shackle between the open position and the closed position when the combination disc padlock is in the unlocked configuration. The housing comprises a slot dimensioned to receive the button portion protrusion and have at least a part of the button portion protrusion extend from the housing, and the slot is further configured to act as guide for the button portion protrusion such that movement of the button portion protrusion is substantially restricted to the slot in the housing.

In accordance with an exemplary embodiment of the present invention, the housing has a disc shape having a perimeter and comprises a slot formed therein along a portion of the perimeter of the housing, and the actuation mechanism comprises an extended projection extending from the shackle and configured to extend through the slot formed in the housing so as to allow the shackle to be turned between the open position and the closed position when the combination disc padlock is in the unlocked configuration.

In accordance with an exemplary embodiment of the present invention, the housing comprises a front housing member and a rear housing member, and wherein the slot is formed in at least one of the front housing member or the rear housing member.

In accordance with an exemplary embodiment of the present invention, the actuation mechanism comprises a gripping area formed on the shackle, and wherein the gripping area is configured to facilitate operation of the shackle between the open position and the closed position when the combination disc padlock is in the unlocked configuration.

In accordance with an exemplary embodiment of the present invention, the actuation mechanism comprises a button portion operatively engaged with the shackle and having a threaded hole, and a screw button threadenly engaged with the threaded hole of the button portion. The housing has a disc shape having a perimeter and comprises a slot formed therein along a portion of the perimeter of the housing, and the screw button is configured to extend through the slot formed in the housing so as to allow the shackle to be turned between the open position and the closed position when the combination disc padlock is in the unlocked configuration.

In accordance with an exemplary embodiment of the present invention, each clutch of the at least one clutches comprises at least one extended fin, and the lock body comprises at least one extended fin receiving slot dimensioned to receive a corresponding extended fin of one of the clutches so that when all of the the extended fin receiving slots and extended fins are aligned with each other, the spindle can be moved in a direction away from the locking ball thereby permitting the locking ball to be pushed by a curved cutout formed in the shackle such that the locking ball is forced to move out of the curved cutout and thereby permitting movement of the shackle into the open position.

In accordance with an exemplary embodiment of the present invention, the lock body comprises a stopping edge configured to control movement of the shackle when the shackle is turned from the opened position to the closed position.

In accordance with an exemplary embodiment of the present invention, a combination code for the combination code core locking mechanism can be reset or reconfigured when the shackle is in the open position, when the shackle is in the open position each of the at least one dials are disengaged from each of the at least one clutches so that each of the at least one dials may be rotated without also causing rotation of each of the at least one clutches, and when the shackle is moved back into the closed position each of the at least one clutches re-operatively engages with each of the at least one dials resulting in the combination code for the combination code core locking mechanism being reset or reconfigured.

In accordance with an exemplary embodiment of the present invention, the shackle further comprises a reset hole positioned therein, a curved cutout dimensioned to receive at least a portion of the locking ball and a recessed area positioned adjacent to the curved cutout. When the combination disc padlock is in the locked configuration and the shackle is in the closed position at least the portion of the locking ball is positioned in the curved cutout of the shackle, when the combination disc padlock is in the unlocked configuration and the shackle is in the open position at least the portion of the locking ball is positioned in the recessed area of the shackle, and the reset hole is exposed in the slot formed along the perimeter of the housing, and the reset hole is dimensioned to receive the screw button in order to permit further actuation of the shackle from the open position to a reset position in which at least the portion of the locking ball is not positioned in the recessed area of the shackle.

In accordance with an exemplary embodiment of the present invention, a combination code for the combination code core locking mechanism can be reset or reconfigured when the shackle is in the reset position, when the shackle is in the reset position each of the at least one dials are disengaged from each of the at least one clutches so that each of the at least one dials may be rotated without also causing rotation of each of the at least one clutches, and when the shackle is moved back into the open positioned or closed position each of the at least one clutches re-operatively engages with each of the at least one dials resulting in the combination code for the combination code core locking mechanism being reset or reconfigured.

In accordance with an exemplary embodiment of the present invention, each of the at least one clutches comprises at least one extended fin, and each of the at least one dials comprises at least one tooth, each of the at least one clutches is operatively engaged with each of the at least one dials through engagement of the at least one extended fin with the at least one tooth, when the shackle is in the closed position or open position the at least one extended fin is operatively engaged with the at least one tooth and rotation of the at least one dials is imparted to the at least one clutches, and wherein when the shackle is in the reset position the at least one extended fin is disengaged with the at least one tooth and rotation of the at least one dials is not imparted to the at least one clutches.

BRIEF DESCRIPTION OF THE DRAWINGS

For a fuller understanding of the nature and objects of the present invention, reference should be made to the following detailed description taken in connection with the accompanying drawings, in which.

DETAILED DESCRIPTION

Figure 1:
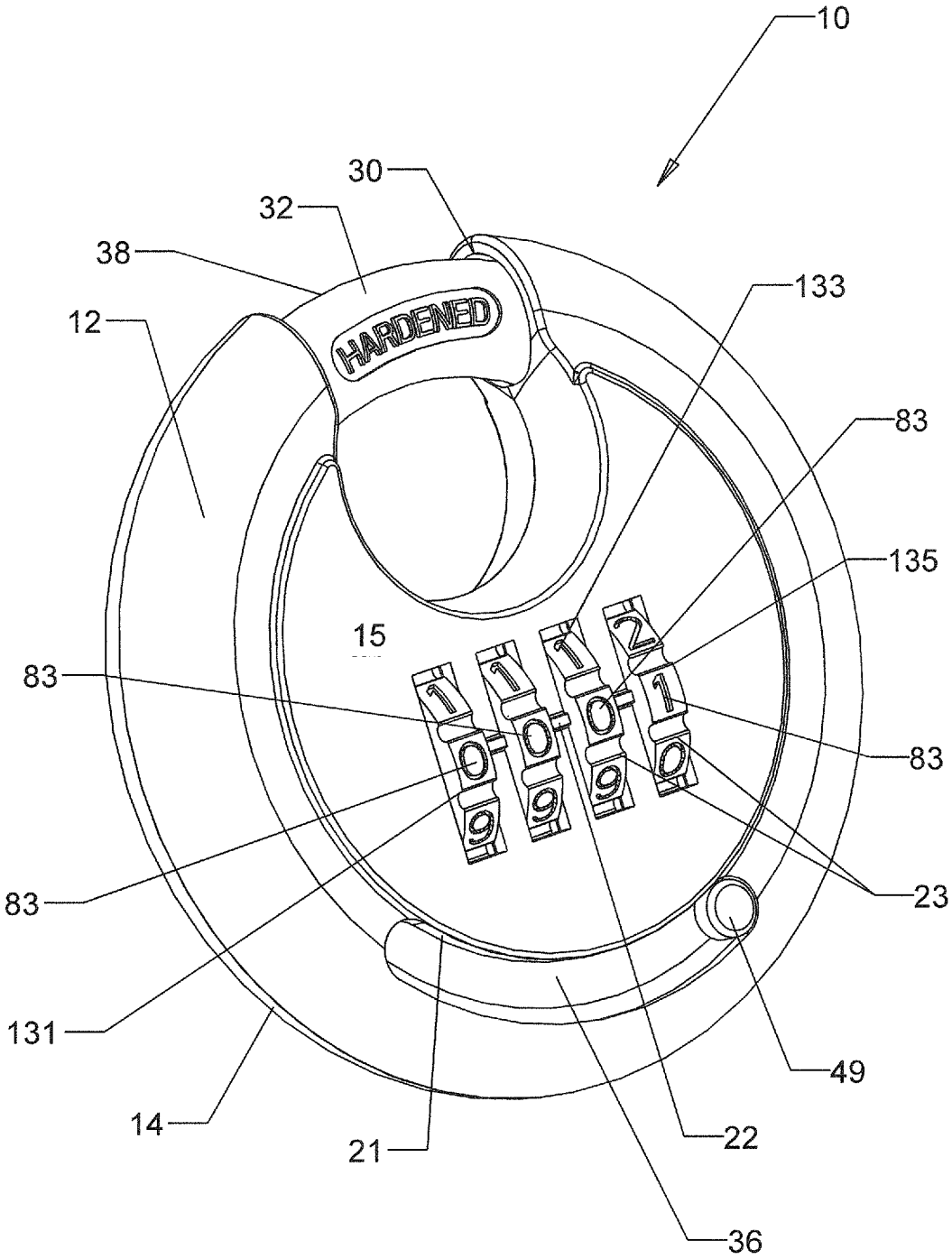
FIG. 1 is a perspective view of an exemplary embodiment of a combination disc padlock according to the present invention.

The present invention now will be described more fully hereinafter with reference to the accompanying figures, in which exemplary embodiments of the invention are shown. The invention may, however, be embodied in many different forms and should not be construed as limited to the embodiments set forth herein. Like reference numerals refer to like elements throughout.

Figure 2:
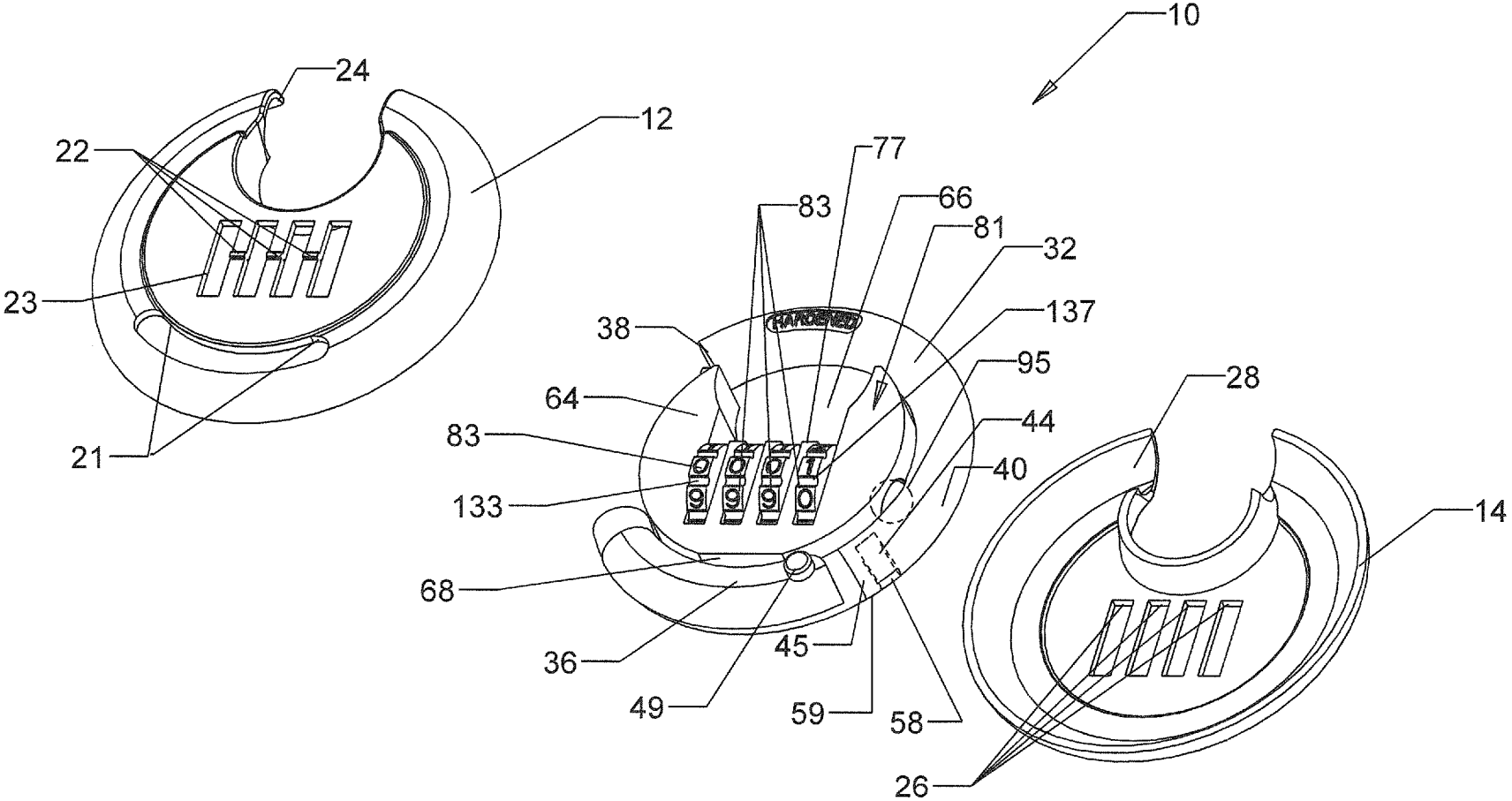
FIG. 2 is an exploded perspective view of the exemplary embodiment of the combination disc padlock shown in FIG. 1.
Figure 3:
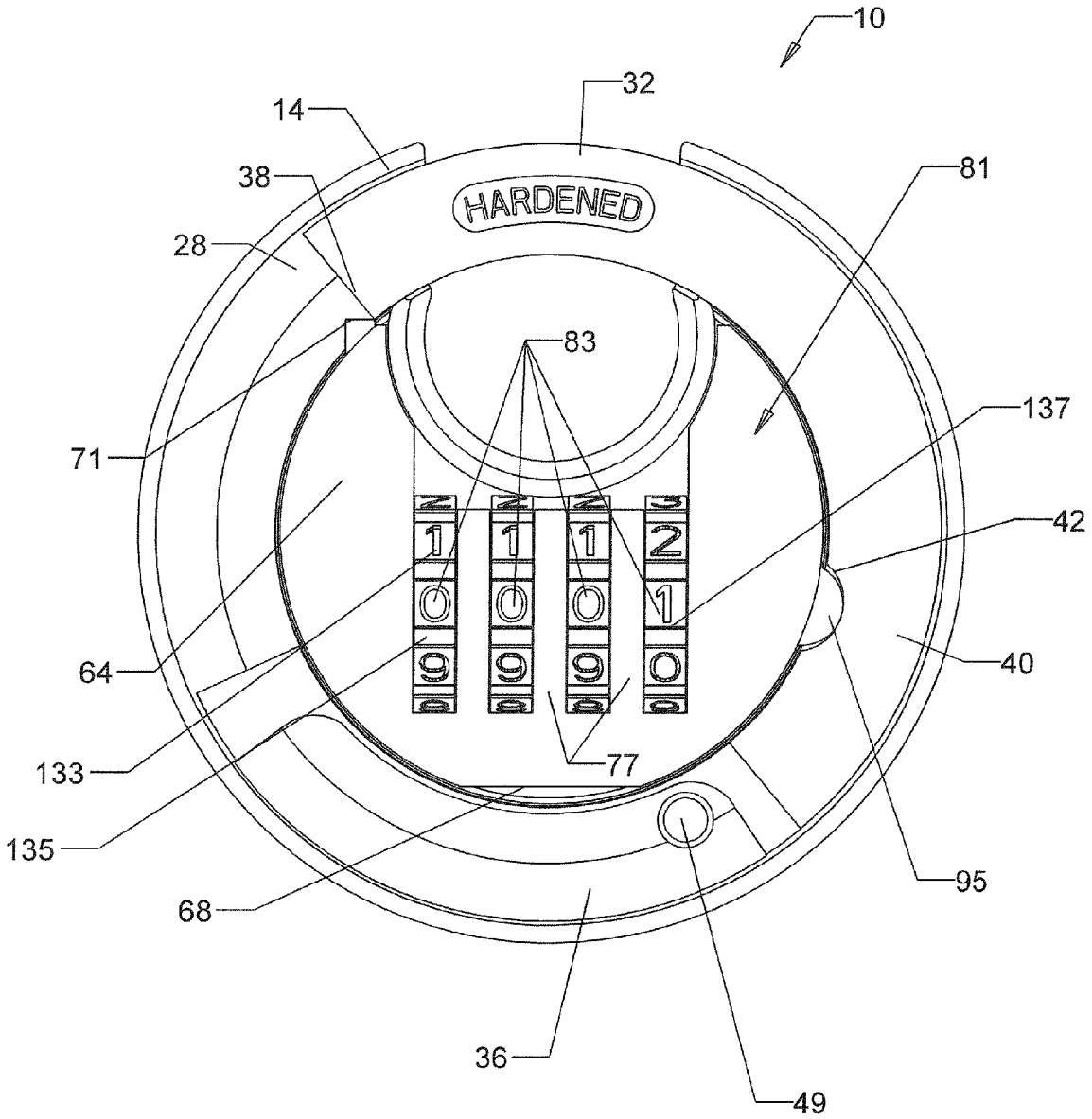
FIG. 3 is a front view of the exemplary embodiment of the combination disc padlock shown in FIG. 1 with a front locking housing member removed.

Referring now to FIGS. 1-3, in which a first exemplary embodiment of a combination disc padlock, generally indicated by reference numeral 10, according to the present invention is shown. The combination disc padlock 10 includes a front housing member 12 and a rear housing member 14, both of which are substantially disc shaped and are configured to contain at least some of the internal components of the combination disc padlock 10. The front housing member 12 and the rear housing member 14 are also configured to be joined together in order to form a body portion 15 of the combination disc padlock 10. It is understood that while the front housing member 12 and rear housing member 14 are referred to as "front" and "rear," these terms are merely relative and do not limit the positioning of the combination disc padlock 10 to any particular orientation.

Referring now to FIGS. 1-2, the front housing member 12 includes an arcuate slot 21 formed therein, at least one alignment bar 22 positioned substantially adjacent to at least one dial receiving area 23 and a front perimeter channel 24 extending around at least a portion of the perimeter of the front housing member 12. The rear housing member 14 also includes at least one dial receiving area 26 that may be positioned in substantial alignment with corresponding dial receiving areas 23 of the front housing member 12 when the front housing member 12 is joined with the rear housing member 14. The rear housing member 14 also includes a rear perimeter channel 28 extending around at least a portion of the perimeter of the rear housing member 14. The rear perimeter channel 28 is positioned for alignment with the front perimeter channel 24 so that when the front housing member 12 and rear housing member 14 are joined together a substantially circular tunnel 30 is formed in the combination disc padlock 10. The front housing member 12 and rear housing member 14 forming the lock housing may be welded together after assembly in order to insure that the components of the combination disc padlock 10 remain in place.

Figure 8:
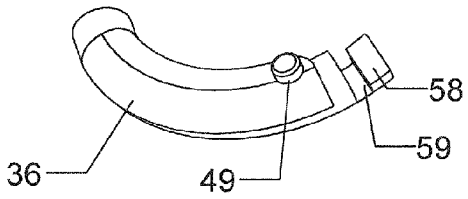
FIG. 8 is a perspective view of an exemplary embodiment of a shackle button portion that may be used in the combination disc padlock according to the present invention.

Referring now to FIGS. 1-6, the substantially circular tunnel 30 of the combination disc padlock 10 is configured and dimensioned to at least contain a shackle 32 and a button portion 36 operatively connected to the shackle 32. The shackle 32 and the button portion 36 are configured for arcuate movement within the substantially circular tunnel 30. The shackle 32 and the button portion 36 may be arcuate in shape. As shown in FIGS. 7A, 7B, 7C and 7D, the shackle 32 includes an exposed end 38 and an unexposed end 40. Positioned on the shackle 32 between the exposed end 38 and the unexposed end 40 is a curved cutout 42. The unexposed end 40 of the shackle 32 may include a notch 44 and tooth 45 that are configured for engagement with the button portion 36. As shown in FIG. 8, the button portion 36 includes an extended protrusion 49, a button tooth 58 and a slot 59. The button tooth 58 and the slot 59 are configured to engage with the notch 44 and tooth 45, respectively, on the shackle 32. The button portion 36 may be positioned within the substantially circular tunnel 30 such that the extended protrusion 49 extends into the arcuate slot 21 in the front housing member 12. As seen, for example in FIGS. 3 and 4, when the shackle 32 and the button portion 36 are assembled together within the substantially circular tunnel 30 they are united so as to form one piece, because there is insufficient room within the substantially circular tunnel 30 for these two components to separate from each other.

Figure 13:
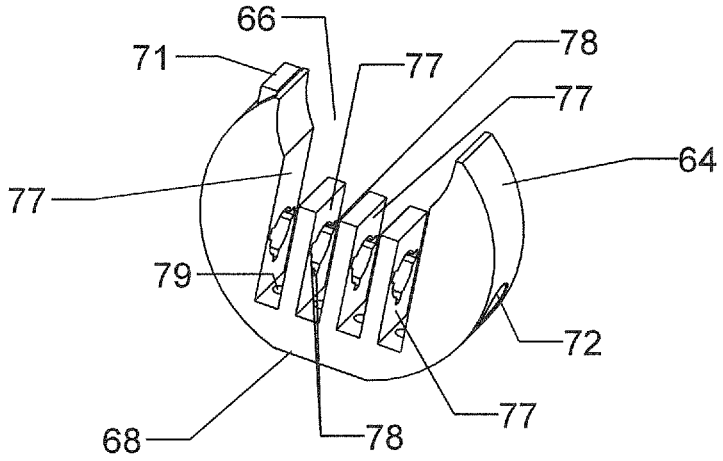
FIG. 13 is a front perspective view of an exemplary embodiment of an inner-locking body that may be used in the combination disc padlock according to the present invention.
Figure 14:
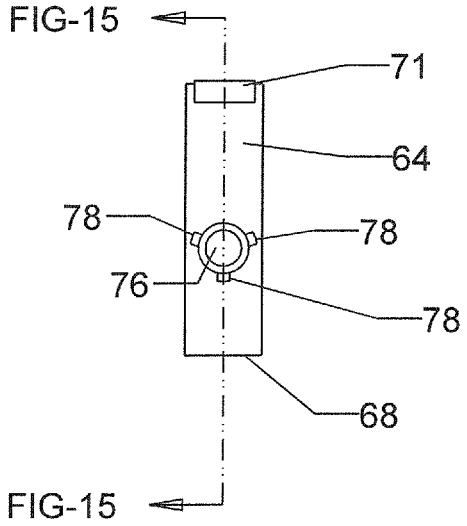
FIG. 14 is a right side view of the exemplary embodiment of the inner-locking body shown in FIG. 13.
Figure 15:
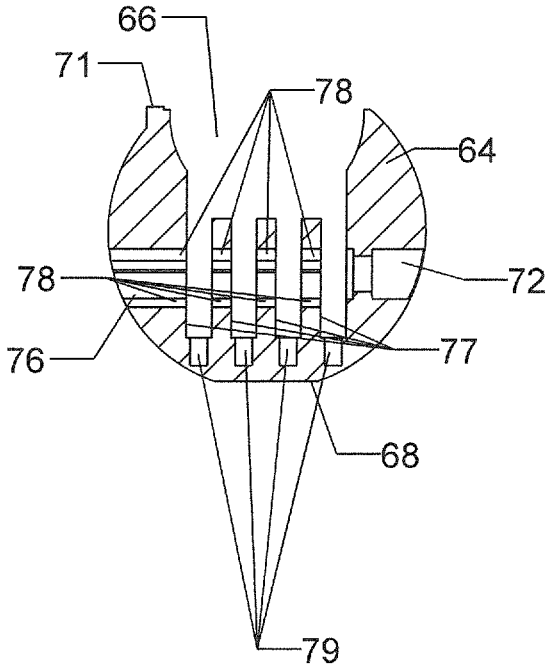
FIG. 15 is a cross-sectional view of the exemplary embodiment of the inner-locking body taken along line 15-15 of FIG. 14.
Figure 16:
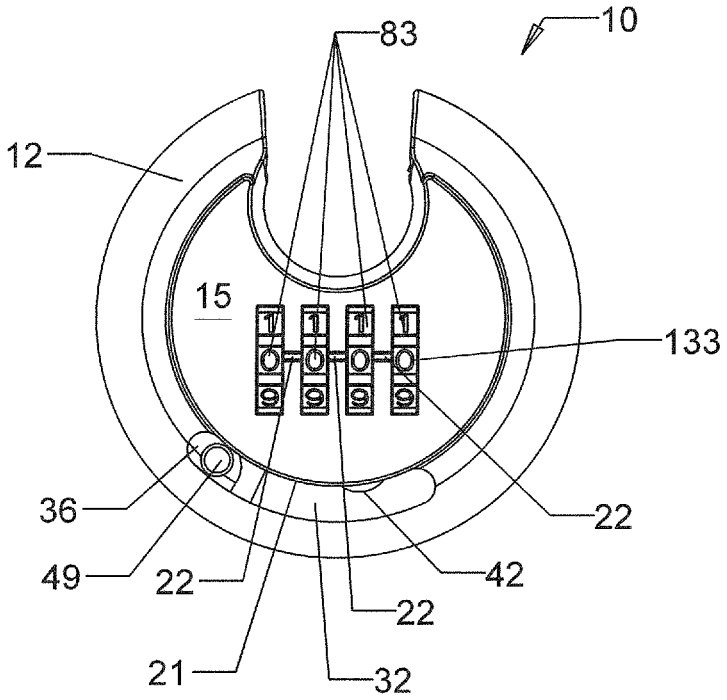
FIG. 16 is a front view of the exemplary embodiment of the combination disc padlock shown in FIG. 1 showing the dials aligned in a lock-open code with the shackle in the open position.
Figure 17:
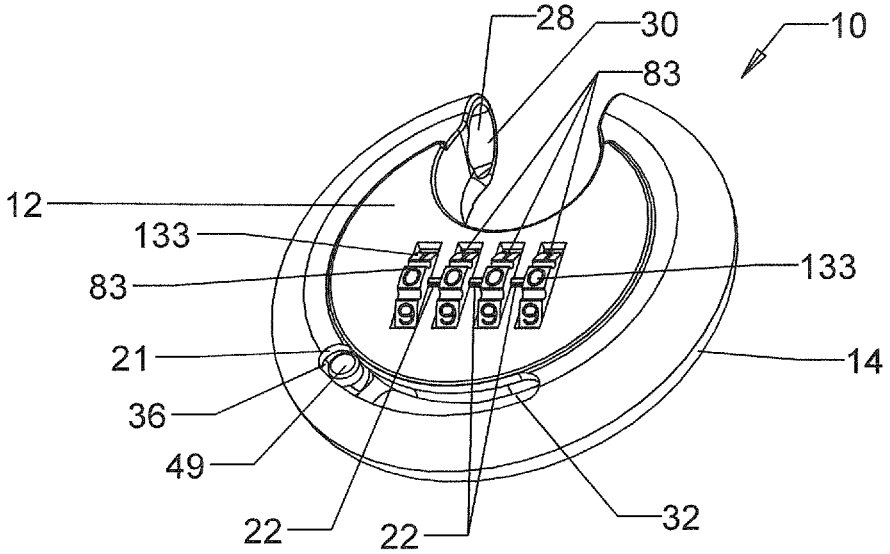
FIG. 17 is a perspective view of the exemplary embodiment of the combination showing the dials aligned in a lock-open code with the shackle in the open position.

Referring now to FIGS. 2-4 and 6, the combination disc padlock 10 may also include a inner lock body 64 positioned between the front housing member 12 and the rear housing member 14, and at least partially surrounded around its periphery by the substantially circular tunnel 30 and the combination of the shackle 32 and button portion 36. As shown in greater detail in FIGS. 13-15, the inner lock body 64 is substantially circular and disc shaped, with a cutout region 66 and at least one flat surface 68 along its periphery. The inner lock body 64 includes a stopping edge 71 protruding from its periphery, and a ball receiving cavity 72 defined within the inner lock body 64. The ball receiving cavity 72 may be substantially concentric with a bore 76 formed through the inner lock body 64. The bore 76 may be oriented as a chord of the inner lock body 64 and pass through at least one blocking wall 77 extending towards the cutout region 66 of the inner lock body 64. At least one extending fin receiving slot 78 may extend radially from the bore 76 into each of the blocking walls 77 and the inner lock body 64. The inner lock body 64 may also include at least one cylindrical hole 79 positioned adjacent to each blocking wall 77.

Figure 12:
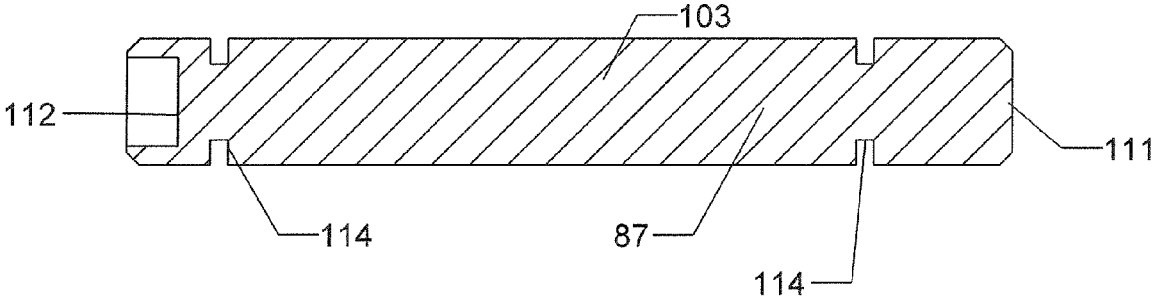
FIG. 12 is a cross sectional view of an exemplary embodiment of a spindle that may be used in the combination disc padlock according to the present invention.

Referring again to FIGS. 2-4 and 6, a combination code core locking mechanism 81 may be formed from the inner lock body 64, at least one dial 83, at least one clutch 85, a spindle 87, a spindle spring 89, a locking ball 95 and a bottom sealed cap 100. The locking ball 95 may be positioned at least partially within the ball receiving cavity 72 of the inner lock body 64. When the shackle 32 is positioned within the substantially circular tunnel 30, and the shackle 32 is in the closed positioned, as shown for example in FIGS. 3 and 4, the ball receiving cavity 72 is substantially aligned with the curved cutout 42 formed in the shackle 32. In this manner, the locking ball 95 may be positioned within both the ball receiving cavity 72 and the curved cutout 42 in order to restrict and/or prevent arcuate movement of the shackle 32. The spindle 87 may be positioned through the bore 76 of the inner lock body 64, and extending at least partially into the ball receiving cavity 72 in order to come into contact with the locking ball 95. The spindle 87 is show in greater detail in FIG. 12, which shows that the spindle 87 may be formed from a substantially cylindrical body 103 and include a face 111 at one end of the spindle 87 and a hole 112 formed in the other end of the spindle 87. A pair of split-ring slots 114 are formed in the substantially cylindrical body 103 of the spindle 87 between the face 111 and the hole 112.

Figure 10:
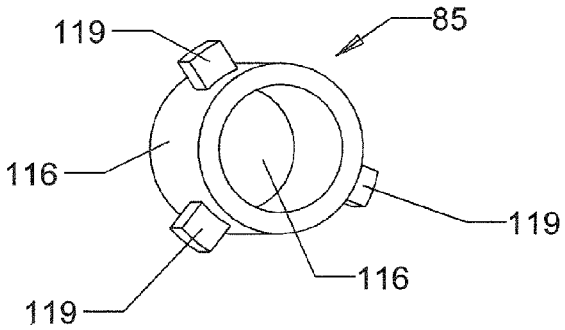
FIG. 10 is a perspective view of an exemplary embodiment of a clutch that may be used in the combination lock portion of the combination disc padlock according to the present invention.

Referring again to FIGS. 2-4 and 6, the spindle spring 89 that may be engaged with the hole 112 in the spindle 87, and configured to urge the spindle 87 towards the locking ball 95 in order to retain the locking ball 95 at least partially within the curved cutout 42 of the shackle 32. The spindle spring 89 is also engaged with the sealed cap 100 that is configured such that it cannot be moved out of the inner lock body 64 since the sealed cap 100 is tightly fit into the inner lock body 64. The sealed cap 100 provides a surface that resists the spindle spring 89 and causes the spindle spring 89 to urge the spindle 87 away from the sealed cap 100. The combination code core locking mechanism 81 may also include the at least one clutch 85 positioned around the substantially cylindrical body 103 of the spindle 87. As shown in FIG. 10, each of the at least one clutch 85 may include a circular body portion 116 and a circular bore 118 formed through the circular body portion 116. One or more extended fins 119, for example three, may extend radially outward from the circular body portion 116 of the clutch 85.

Figure 4:
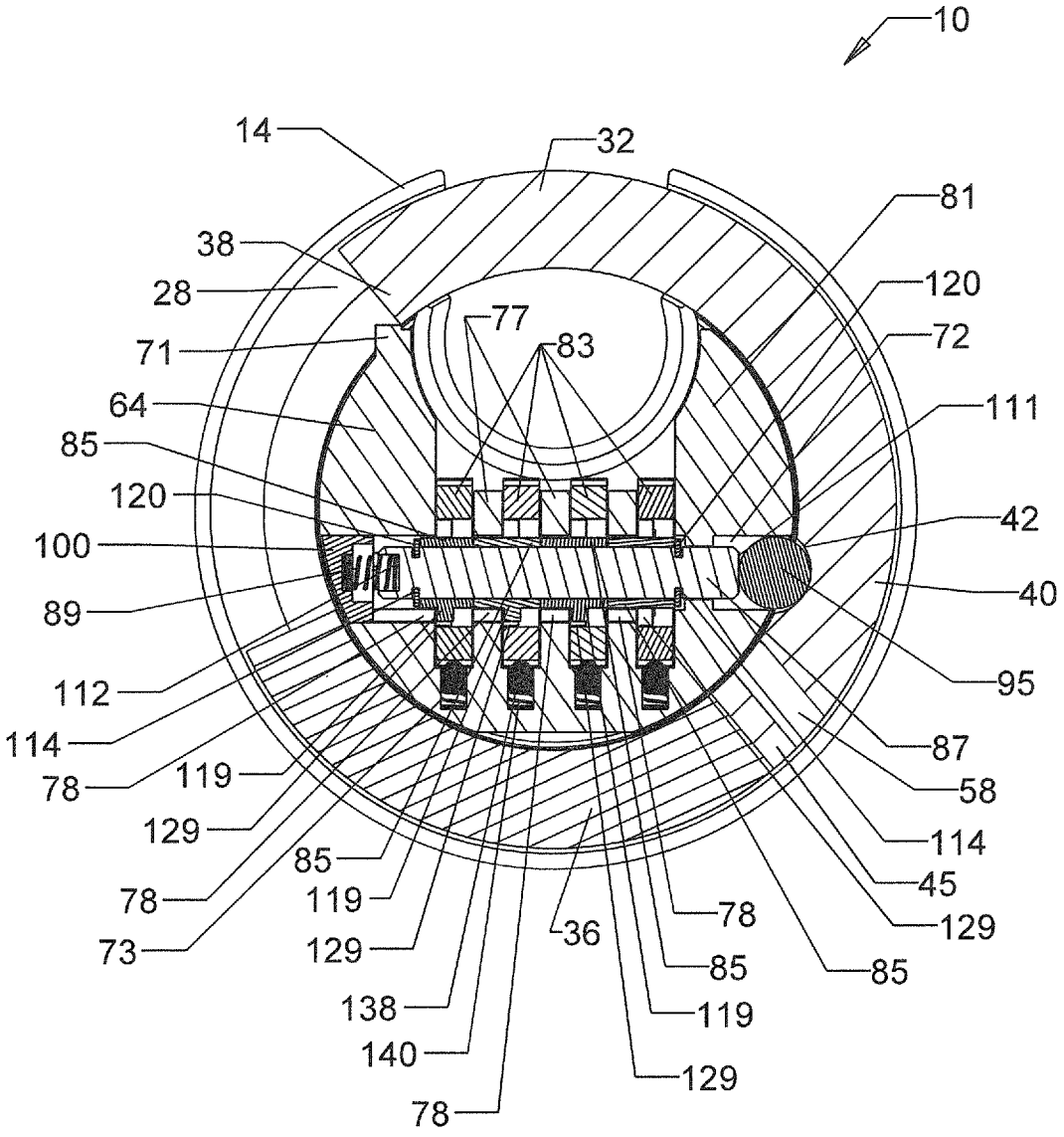
FIG. 4 is a cross-sectional view of the exemplary embodiment of the combination disc padlock shown in FIG. 1 with the cross-section taken through the plane defined by the disc of the padlock.
Figure 6:
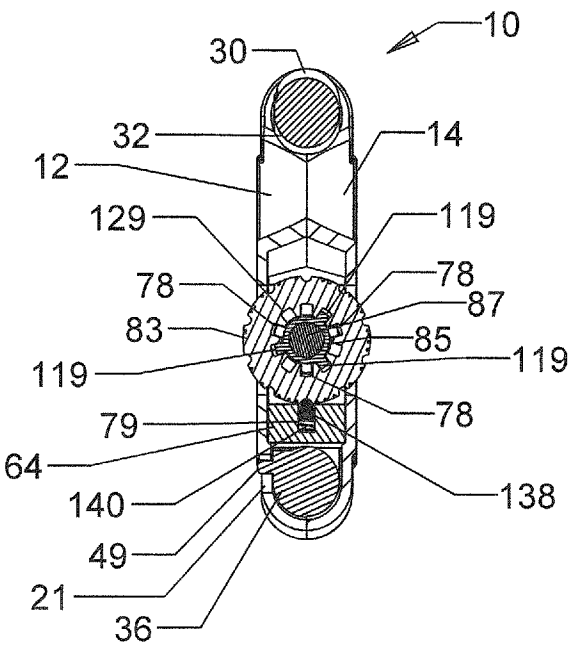
FIG. 6 is a cross-sectional view of the exemplary embodiment of the combination disc padlock shown in FIG. 5 taken along line 6-6 of FIG. 5.
Figure 11:
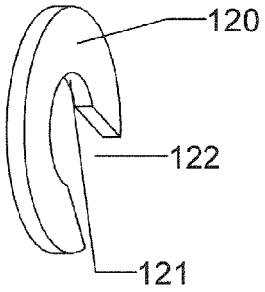
FIG. 11 is a perspective view of an exemplary embodiment of a split-ring that may be used in the combination padlock shown according to the present invention.

Referring now to FIG. 4, it can be seen that the at least one clutch 85, positioned around the substantially cylindrical body 103 of the spindle 87 may be held in place by a pair of split rings 120 positioned in the split-ring slots 114 of the spindle 87 so that movement of the spindle 87 along its longitudinal axis is transferred to the at least one clutch 85. As shown in greater detail in FIG. 11, the split ring 120 includes a substantially circular interior cavity 121 and a cutout portion 122 that is configured to go around the split-ring slot 114 of the spindle 87. It is understood that the section of the cutout portion 122 closer to the circular interior cavity 121 may have a width that is slightly less than the diameter of the substantially cylindrical body 103 at the split-ring slot 114 so that the split ring 120 may be snapped into the split-ring slot 114 and retained on the spindle 87. It is further understood that this mechanism to installing and retaining the split ring 120 on the spindle 87 is merely exemplary, and that the present invention is not limited to any particular mechanism regarding the splint ring 120.

Figure 9:
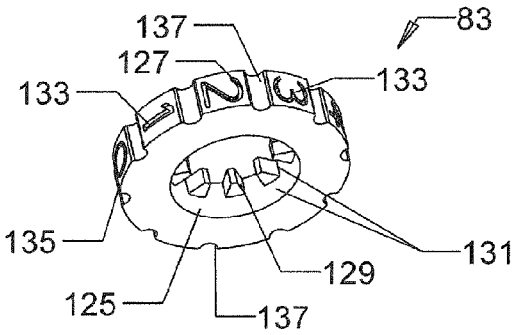
FIG. 9 is a perspective view of an exemplary embodiment of a dial that may be used in the combination lock portion of the combination disc padlock according to the present invention.

Referring again to FIGS. 2-4 and 6, the combination code core locking mechanism 81 may also include at least one dial 83, which is operatively engaged with a clutch 85, i.e. each of the at least one dial 83 is operatively engaged with a clutch 85 of the at least one clutch 85. It is understood that the dial 83 is engaged with the clutch 85 such that rotational movement of the dial 83 is imparted to the clutch 85. It is further understood that the circular bore 118 of the clutch 85 may be dimensioned so that rotational motion of the dial 83 and/or the clutch 85 is not imparted to the spindle 87, as a result of the circular bore 118 having a diameter slightly larger than the diameter of the substantially cylindrical body 103 of the spindle 87. As a result, the dial 83 and/or clutch 85 may be rotated about the longitudinal axis of the spindle 87 without the spindle 87 also being rotated about its longitudinal axis. As shown in greater detail in FIG. 9, the dial 83 includes an inside surface 125 and an outside surface 127. The inside surface 125 may have a diameter slightly greater than the diameter of the circular body portion 116 of the clutch 85 so that the clutch 85 and the dial 83 are able to operatively engaged with each other while also being independently rotatable about the spindle 87 when not operatively engaged with each other. Extending from the inside surface 125 towards the center of the dial 83 are a plurality of teeth 129 that define a plurality of slots 131, where each slot 131 is formed between a pair of the plurality of teeth 129. Each slot 131 may be configured and dimensioned to receive and retain an extended fin 119 of the clutch 85 so that when the extended fin 119 is received and retained within the slot 131, the clutch 85 and the dial 83 are in interlocked engagement permitting both the clutch 85 and the dial 83 to be configured to rotate about the spindle 87. The dial 83 may also include one or more indicia 133 formed on the outside surface 127 thereof. It is understood that the number of slots 131 formed in the dial 83 may correspond to the number of separate and distinct indicia 133 formed on the outside surface 127 of the dial 83. Each of the indicia 133 represent one component of the combination that may be used to position the clutches 85 in the required location for unlocking the combination code core locking mechanism 81, as will be discussed further below. It is understood that the indicia 133 may be any symbol, color, design, character or other mark, and may be for example alpha numeric characters. Each indicia 133 may be disposed on and/or formed on or in a separate face 135 positioned around the outside surface 127 of the dial 83. Each face 135 may be separated from adjacent faces 135 by channels 137 formed on the outside surface 59 of the rotatable dial 133.

Figure 5:
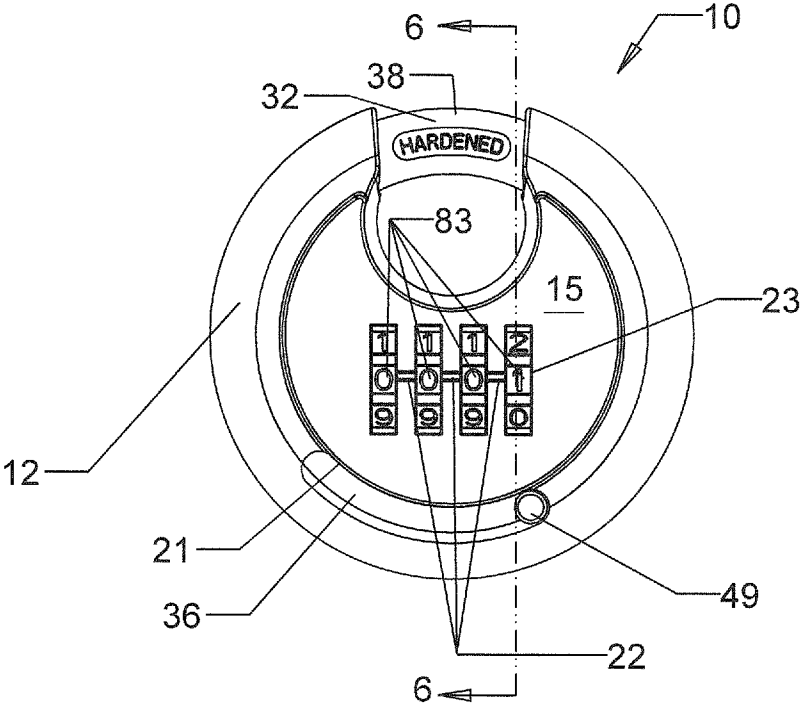
FIG. 5 is a front view of the exemplary embodiment of the combination disc padlock according to the present invention.
Figure 7A:
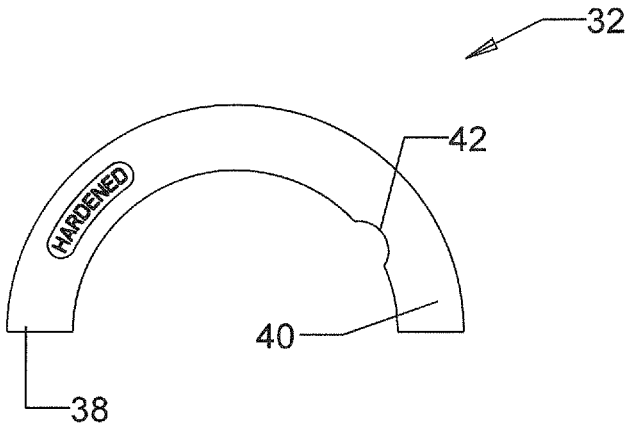
FIG. 7A is a front view of an exemplary embodiment of a shackle that may be used in the combination disc padlock according to the present invention.
Figure 7B:
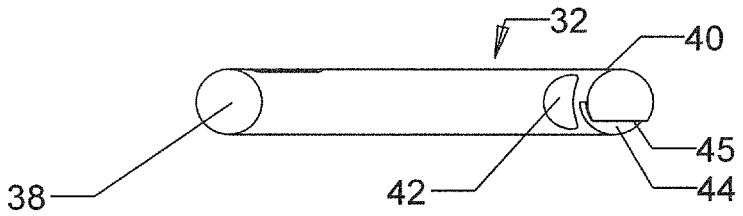
FIG. 7B is a bottom plan view of the exemplary embodiment of the shackle shown in FIG. 7A.
Figure 7C:
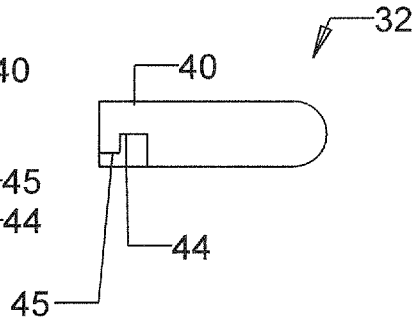
FIG. 7C is a side view of the exemplary embodiment of the shackle shown in FIG. 7A.
Figure 7D:
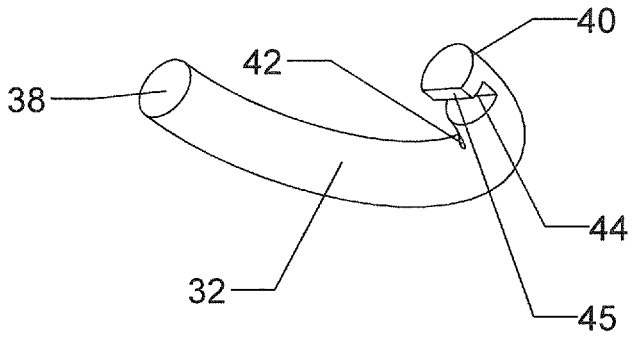
FIG. 7D is a perspective view of the exemplary embodiment of the shackle shown in FIG. 7A.

Referring again to FIGS. 4 and 6, the combination code core locking mechanism 81 of the combination disc padlock 10 may also include a plurality of pins 138, where each pin 138 is positioned for operative engagement with a corresponding dial 83. Each pin 138 is also operatively coupled to a pin spring 140 that is configured to urge each pin 138 in a direction towards the dial 83 corresponding to the pin 138. Each pin 138 and pin spring 140 are mounted in a cylindrical hole 79 forming a receiving cavity in the inner lock body 64 for each pin 138 and pin spring 140. Each pin spring 140 is configured and positioned so as to urge the corresponding pin 138 into engagement with the outside surface 127 of the corresponding dial 83. As the dial 83 is rotated the pin 138 is moved in and out of the channels 137 formed in between the faces 135 of the dial 83 in order to cause an indication, for example an audible sound, that the dial 83 is in the proper orientation for a particular desired indicia 133. In addition to the indication produced by the cooperation of the pin 138 and channels 137 of the dial 83, the movement of the pin 138 into engagement with the channel 137 may also provide a structural indication that the particular desired indicia 133 is in its proper orientation. For example, as shown in FIGS. 1 and 5, that the particular desired indicia 133 is aligned with the alignment bar 22 in order to indicate the code and/or combination that is the padlock is currently set to.

Referring now to FIGS. 3-6 and 16-20, the operation and use of the combination disc padlock 10 according to the present invention will now be discussed. It is understood that the shackle 32 of the padlock 10 is moveable between a closed position, as shown for example in FIGS. 3-6, and an open position, as shown for example in FIGS. 16-20. It is further understood that the shackle 32 may be positionable between the closed and open positions at any location between the closed and open positions. It is also understood that the combination code core locking mechanism 81 is configured to have a locked configuration, as shown for example in FIG. 4, and an unlocked configuration, as shown for example in FIG. 18. It is further understood that when the combination code core locking mechanism 81 is in the locked configuration, the combination disc padlock 10 is also considered to be in a locked configuration, and likewise when the combination code core locking mechanism 81 is in the unlocked configuration, the combination disc padlock 10 is also considered to be in the unlocked configuration. It is further understood that even while the combination code core locking mechanism 81 is in the unlocked configuration the shackle 32 may still be in the closed position, since the button portion 36 may not yet have been actuated in order to move the shackle 32 into the open position. However, it is understood, as discussed further below, that the shackle 32 may not be moved into the open position unless the combination code core locking mechanism 81 is placed in the unlocked configuration.

Referring now to FIGS. 3-6, in which the closed position of the shackle 32 and locked configuration of the combination code core locking mechanism 81 are shown. In the locked configuration of the combination code core locking mechanism 81 the spindle 87 is urged along its longitudinal axis towards the locking ball 95, thereby positioning the locking ball at least partially in both the curved cutout 42 of the shackle 32 and the ball receiving cavity 72 of the inner lock body 64. Since the inner lock body 64 is prevented from rotating due to its positioning within the front housing member 12 and rear housing member 14, the locking ball 95 is held in place by the inner lock body 64, which in turn prevents arcuate movement of the shackle 32. The shackle 32 is also prevented from further counter-clockwise movement from its closed position due to the positioning of the stopping edge 71 on the inner lock body 64. Since each clutch 85 of the combination code core locking mechanism 81 has at least one extended fin 119, for example three, movement of the spindle 87 along its longitudinal axis away from the locking ball 95 is restricted and/or prevented unless all of the extended fins 119 of all of the clutches 85 are aligned with the corresponding extended fin receiving slots 78 of the inner lock body 64. Instead, when at least one of the extended fin 119 of at least one clutch 85 is not aligned with the corresponding extended fin receiving slot 78, the unaligned extended fin 119 (or fins) may be engaged with the corresponding blocking wall 77 (or walls) in order to restrict and/or prevent movement of the spindle 87 along its longitudinal axis away from the locking ball 95. Therefore, since each clutch 85 is operatively engaged with a corresponding dial 83, when each of the dials 83 have not been set to the correct code and/or combination for the combination code core locking mechanism 81, at least one extended fin 119 will prevent movement of the spindle 87 away from the locking ball 95 thereby maintaining contact between the curved cutout 42 of the shackle 32 and the locking ball 95 in order to prevent clockwise arcuate rotation of the shackle 32 into the open position. As shown for example in FIG. 4, the last dial 83 on the right-hand side has not been set to the correct indicia for the correct code and/or combination, and therefore at least one extended fin 119 of the clutch 85 associated with the dial 83 is not aligned with the extended fin receiving slot 78 of the inner lock body 64, which can also be seen in FIG. 6. As a result, the spindle 87 cannot be moved away from the locking ball 95, and the shackle 32 is maintained in the closed position.

Referring now to FIGS. 16-20, in which the open position of the shackle 32 and unlocked configuration of the combination code core locking mechanism 81 are shown. In order to place the combination code core locking mechanism 81 into the unlocked configuration, all of the dials 83 must be set to the code and/or combination by aligning the appropriate indicia 133 for each dial 83 with the alignment bar 22 on the front housing member 12. Since each dial 83 is operatively engaged with a corresponding clutch 85, aligning the appropriate indicia 133 for a respective dial 133 also aligns the extended fins 119 of the corresponding clutch 85 with the extended fin receiving slot 78 of the inner lock body 64. This alignment permits the extended fins 119 to pass through the extended fin receiving slots 78 so that the blocking walls 77 no longer prohibit movement of the clutches 85, and as a result the spindle 87 may be permitted to move along its longitudinal axis in a direction away from the locking ball 95. As a result of the movement of the locking ball 95 no longer being restricted and/or prohibited by the spindle 87 a clockwise force applied to the extended protrusion 49 of the button portion 36 will cause clockwise movement of the shackle 32 into the open position, as a result of the engagement between the button portion 36 and the shackle 32. It is understood that the shackle 32 can be moved back to the closed position by applying a counter-clockwise force to the extended protrusion 49 until the exposed end 38 of shackle 32 contacts the stopping edge 71 of inner lock body 64.

In order to place the combination disc padlock 10 into the locked configuration, the extended protrusion 49 of the button portion 36 is urged counter-clockwise until exposed end 38 of the shackle 32 hits the stopping edge 71 of the inner lock body 64. Then, the curved cutout 42 of the shackle 32 will once again be aligned with locking ball 95. The spindle 87 is then pushed by spring 89 such that the extended fins 119 of the clutches 85 engage with the corresponding teeth 129 of the corresponding dials 83. With this engagement relationship, turning of the dials 83 will also turn the clutches 85 in the same manner. The dials 83 can then be rotated such that the extended fins 119 of the clutches 85 will once again not align with the extended-fin receiving slots 78 of the inner lock body 64. Thereafter, spindle 87 cannot be moved in a direction way from the locking ball 95, and the locking ball 95 will be engaged with curved region 42 of shackle 32 thereby preventing movement of the shackle 32.

Figure 18:
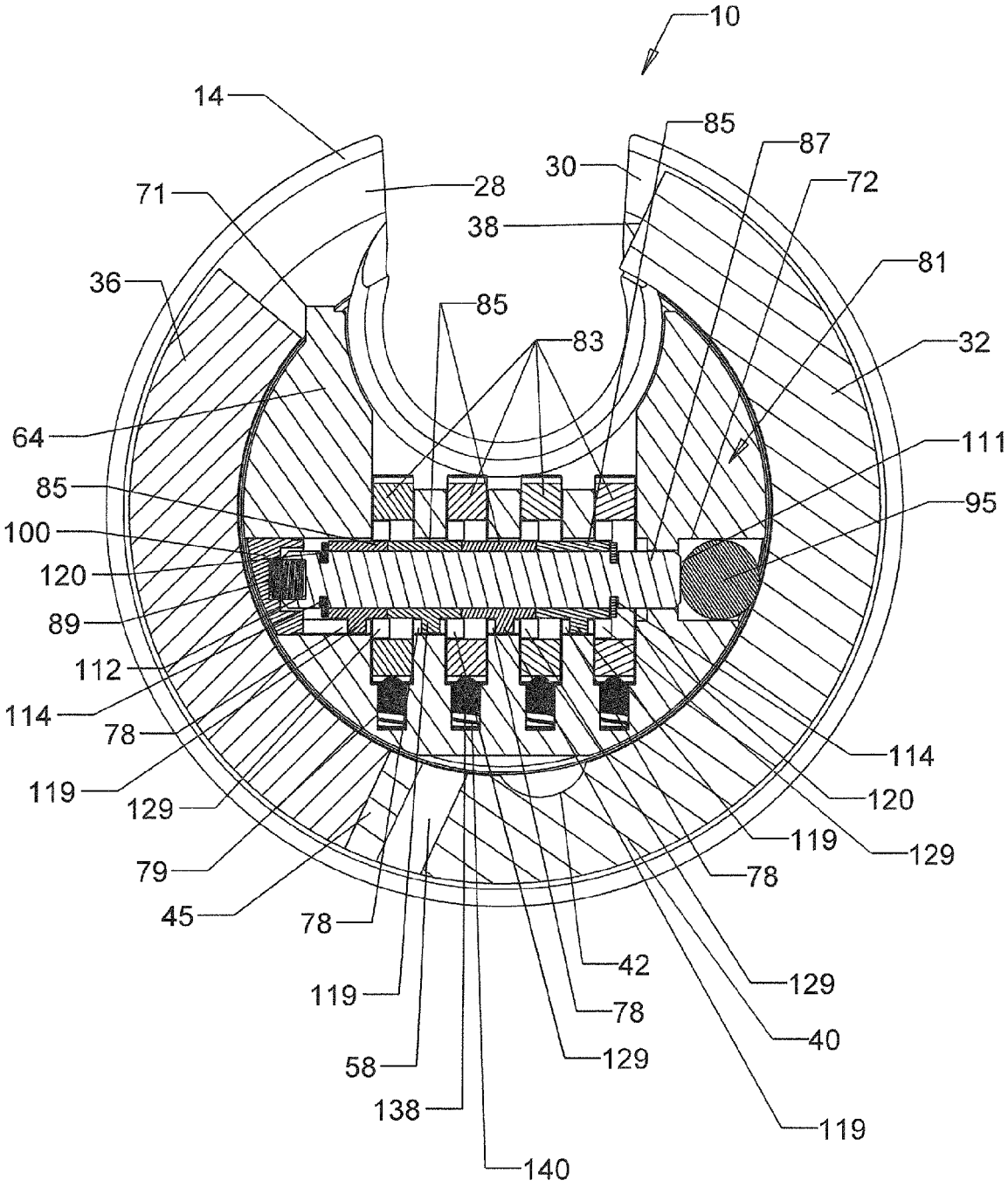
FIG. 18 is a cross-sectional view of the exemplary embodiment of the combination disc padlock showing the shackle in the open position.
Figure 20:
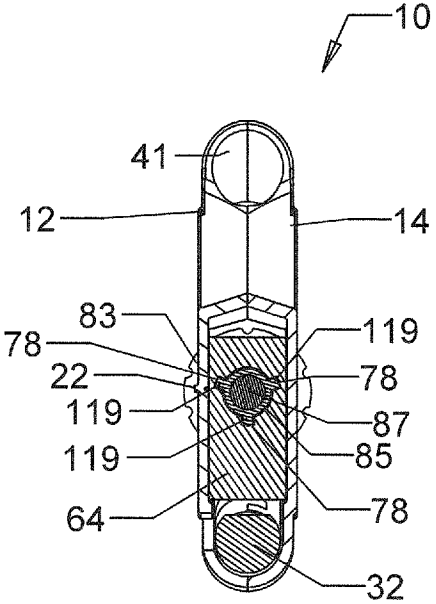
FIG. 20 is a cross-sectional view of the exemplary embodiment of the combination disc padlock taken along line 20-20 shown in FIG. 19.
Figure 19:
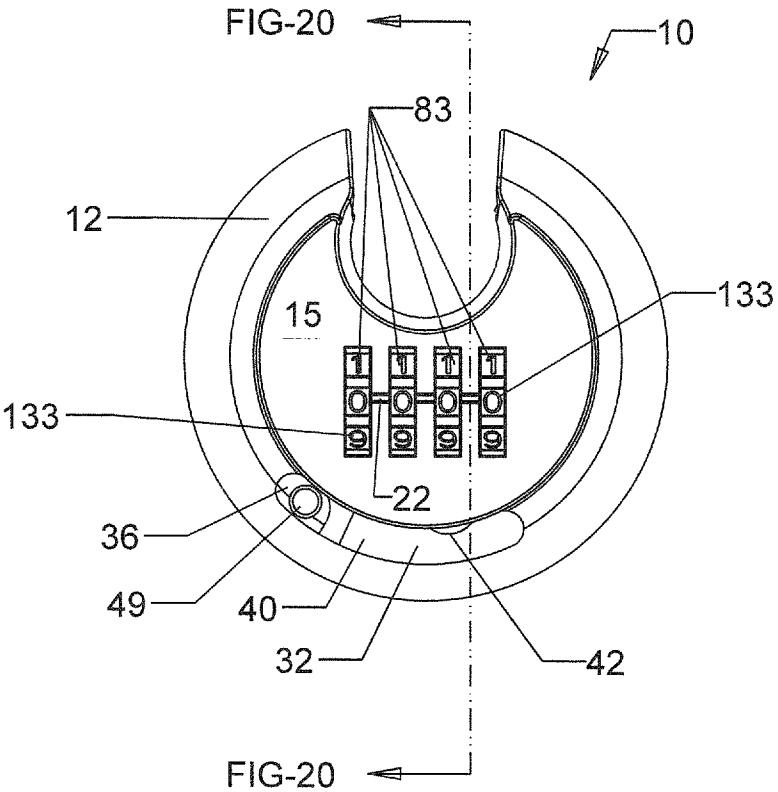
FIG. 19 is a front view of the exemplary embodiment of the combination disc padlock shown in FIG. 1 showing the dials aligned in a lock-open code with the shackle in the open position.

Referring now to FIG. 18, resetting and/or reconfiguring of the code and/or combination that may be used to unlock the combination code core locking mechanism 81 will now be discussed. When the shackle 32 is in the open position, and the combination code core locking mechanism 81 is in the unlocked configuration, the spindle 87 is moved in a direct away from the locking ball 95, and the extended fins 119 of the clutches 85 are disengaged from the teeth 129 of the dials 83. As the extended fins 119 of the clutches 85 are moved, they are received within with the extended-fin receiving slot 78 of the inner lock body 64. As a result, the dials 83 can be turned without also turning the clutches 85 so that indicia 133 required to be displayed on the dials 83 in order to unlock the combination code core locking mechanism 81 may be reset and/or reconfigured. After resetting or setting the desired combination, the combination disc padlock 10 may be placed into the locked configuration as discussed above.

It is understood that the combination disc padlock 10 and its components may be made from any suitable materials, for example metals, metal alloys, plastics, composite materials or any combination thereof. It is understood that the choice of materials may depend upon the desired durability, security level, cost and ease of manufacture, and that the various components of the combination disc padlock 10 may be made from a variety of different materials.

Figure 21:
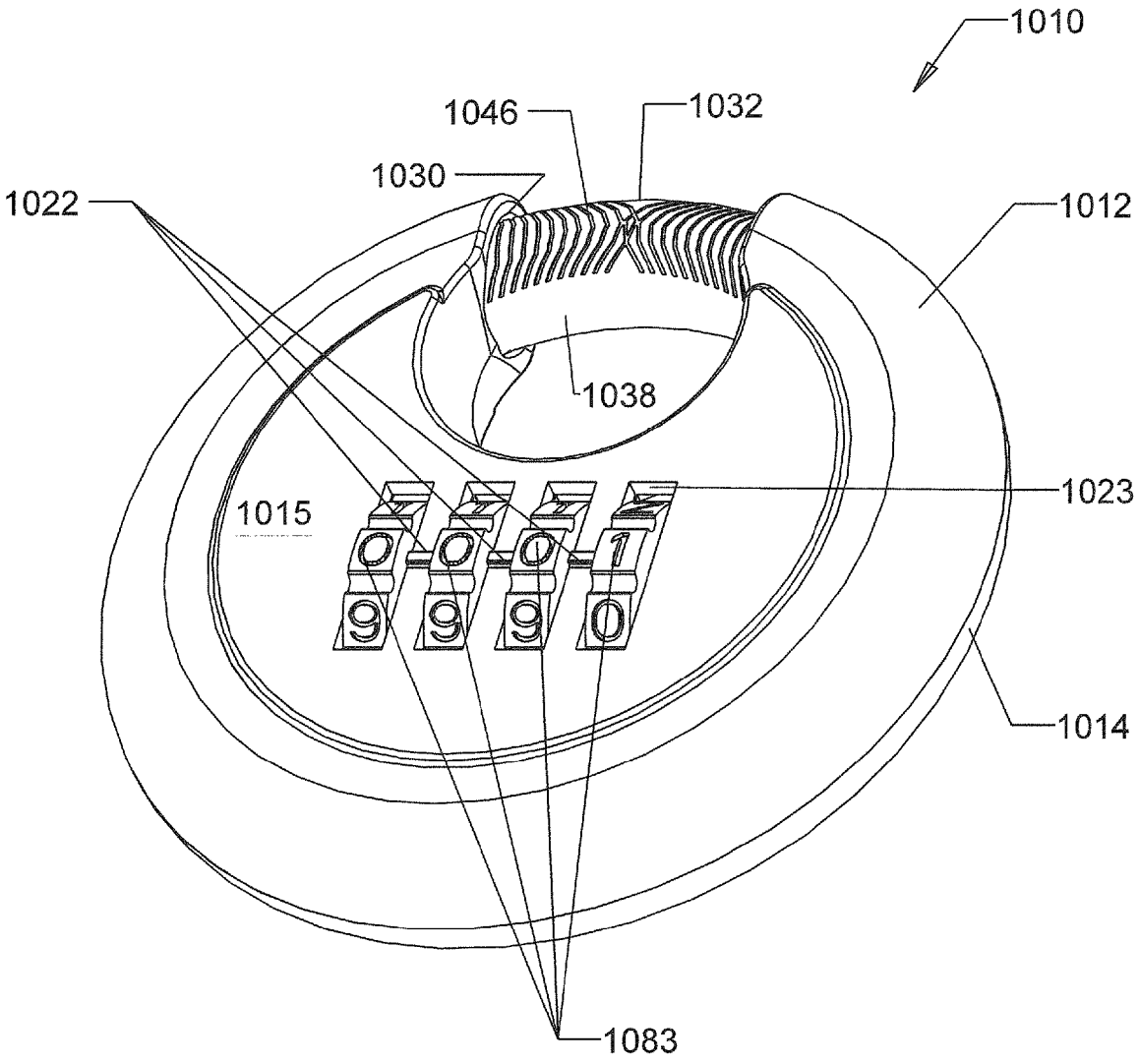
FIG. 21 is a perspective view of another exemplary embodiment of a combination disc padlock according to the present invention.
Figure 22B:
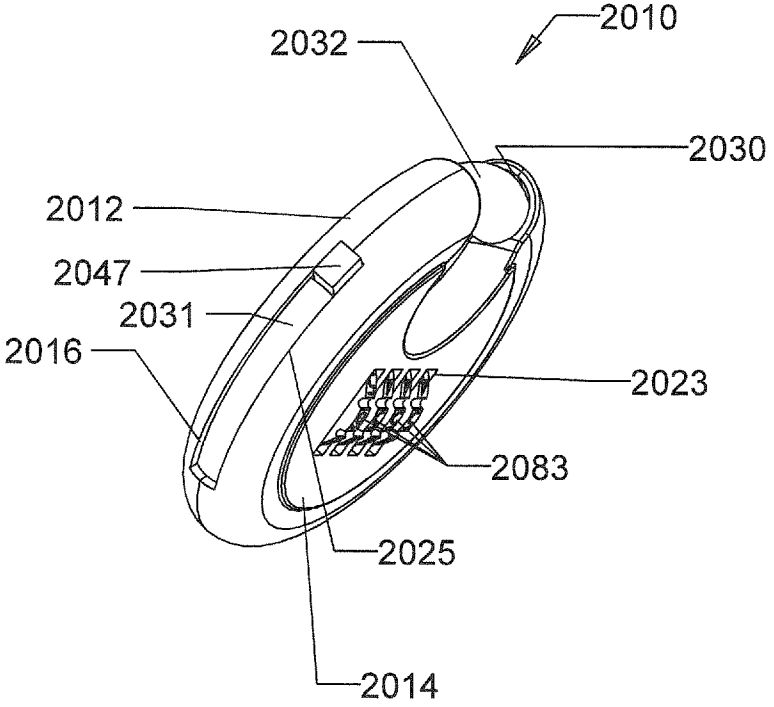
FIG. 22B is a rear perspective view of the other exemplary embodiment of the combination disc padlock shown in FIG. 22A showing details of a slot area in which an extended projection resides.
Figure 22A:
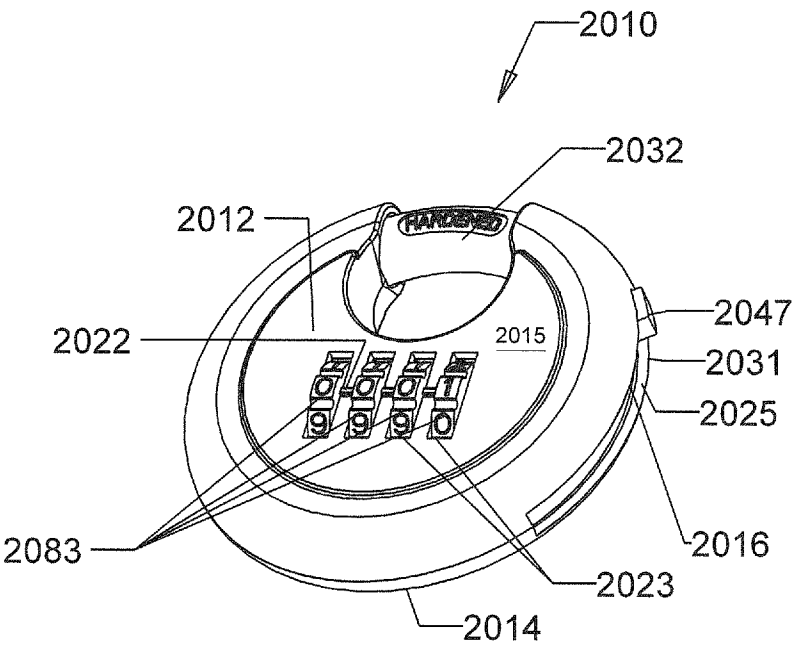
FIG. 22A is a front perspective view of another exemplary embodiment of a combination disc padlock according to the present invention.

Referring now to FIG. 21, in which a second exemplary embodiment of a combination disc padlock, generally indicated by reference numeral 1010, according to the present invention is shown. The combination disc padlock 1010 includes a front housing member 1012 and a rear housing member 1014, both of which are substantially disc shaped and are configured to contain at least some of the internal components of the combination disc padlock 1010. The front housing member 1012 and the rear housing member 1014 are also configured to be joined together in order to form a body portion 1015 of the combination disc padlock 1010. It is understood that while the front housing member 1012 and rear housing member 1014 are referred to as "front" and "rear," these terms are merely relative and do not limit the positioning of the combination disc padlock 1010 to any particular orientation. The front housing member 1012 may include at least one alignment bar 1022 positioned substantially adjacent to at least one dial receiving area 1023. The rear housing member 1014 also includes at least one dial receiving area (not shown) that may be positioned in substantial alignment with corresponding dial receiving areas 1023 of the front housing member 1012 when the front housing member 1012 is joined with the rear housing member 1014. Both the front housing member 1012 and the rear housing member 1014 include a perimeter channel that are positioned for alignment with each other so that when the front housing member 1012 and rear housing member 1014 are joined together a substantially circular tunnel 1030 is formed in the combination disc padlock 1010. The front housing member 1012 and rear housing member 1014 forming the lock housing may be welded together after assembly in order to insure that the components of the combination disc padlock 1010 remain in place. The substantially circular tunnel 1030 of the combination disc padlock 1010 is configured and dimensioned to at least contain a shackle 1032 that is configured for arcuate movement within the substantially circular tunnel 1030. The shackle 1032 may be arcuate in shape, and include at least an exposed end 1038 and a gripping area 1046. Contained within the body portion 1015 of the combination disc padlock 1010 is a combination code core locking mechanism (not shown) similar to the combination code core locking mechanism 81 discussed above with respect to the first embodiment of the present invention. For example, the combination code core locking mechanism of this second embodiment includes at least one dial 1083 that is operatively engaged with a clutch (not shown).

As discussed above with respect to the first embodiment of the present invention, when the dials 1083 are aligned in the correct code and/or combination for the combination code core locking mechanism (not shown), the combination code core locking mechanism is in the unlocked configuration, and as a result the shackle 1032 can be turned clockwise in order to place the shackle 1032 into the open position. The gripping area 1046 provides an extensive gripping area for turning the shackle 1032, and this exemplary embodiment illustrates that a button is not the only element that can be used as a mechanism for urging the shackle 1032 into the open and/or closed position.

It is understood that the combination disc padlock 1010 of the second exemplary embodiment of the present invention includes the same or similar components as the combination disc padlock 10 according to the first exemplary embodiment of the present invention. It is also understood that operation and use, for example, locking and unlocking the combination disc padlock 1010, opening and closing the shackle 1032 and resetting the code and/or combination for the combination disc padlock 1010 may be performed in the same manner as discussed above with respect to the first exemplary embodiment of the present invention.

Referring now to FIGS. 22A, 22B and 23-24, in which a third exemplary embodiment of a combination disc padlock, generally indicated by reference numeral 2010, according to the present invention is shown. The combination disc padlock 2010 includes a front housing member 2012 and a rear housing member 2014, both of which are substantially disc shaped and are configured to contain at least some of the internal components of the combination disc padlock 2010. The front housing member 2012 and the rear housing member 2014 are also configured to be joined together in order to form a body portion 2015 of the combination disc padlock 2010. It is understood that while the front housing member 2012 and rear housing member 2014 are referred to as "front" and "rear," these terms are merely relative and do not limit the positioning of the combination disc padlock 2010 to any particular orientation.

Referring again to FIGS. 22A, 22B and 23-24, the front housing member 2012 includes a rectangular cutout slot 2016 formed in the perimeter thereof, at least one alignment bar 2022 positioned substantially adjacent to at least one dial receiving area 2023 and a front perimeter channel (not shown) extending around at least a portion of the perimeter of the front housing member 2012. The rear housing member 2014 also includes at least one dial receiving area (not shown) that may be positioned in substantial alignment with corresponding dial receiving areas 2023 of the front housing member 2012 when the front housing member 2012 is joined with the rear housing member 2014. The rear housing member 2014 may also include a rectangular cutout slot 2025 formed in the perimeter thereof, and positioned for alignment with the rectangular cutout slot 2016 of the front housing member 2012 when the rear housing member 2014 is joined together with the front housing member 2012. The rear housing member 2014 also includes a rear perimeter channel 2028 extending around at least a portion of the perimeter of the rear housing member 2014. The rear perimeter channel 2028 is positioned for alignment with the front perimeter channel (not shown) so that when the front housing member 2012 and rear housing member 2014 are joined together a substantially circular tunnel 2030 is formed in the combination disc padlock 2010. Furthermore, the rectangular cutout slot 2016 of the front housing member 2012 and the rectangular cutout slot 2025 of the rear housing member 2014 are positioned for alignment when the housing members are joined together in order to form an arcuate channel 2031 in the perimeter of the body portion 2015 of the combination disc padlock 2010. The front housing member 2012 and rear housing member 2014 forming the lock housing may be welded together after assembly in order to insure that the components of the combination disc padlock 2010 remain in place.

Still referring to FIGS. 22A, 22B and 23-24, the substantially circular tunnel 2030 of the combination disc padlock 2010 is configured and dimensioned to at least contain a shackle 2032. The shackle 2032 is configured for arcuate movement within the substantially circular tunnel 2030, and the shackle 2032 may be arcuate in shape. As shown in FIG. 25, the shackle 2032 includes an exposed end 2038 and an unexposed end 2040. Positioned on the shackle 2032 between the exposed end 2038 and the unexposed end 2040 is a curved cutout 2042. The shackle 2032 also includes an extended projection 2047 that may be configured and dimensioned to be positioned within the arcuate channel 2031 in order to provide a mechanism by which arcuate movement of the shackle 2032 within the combination disc padlock 2010 may be effected.

Figure 23:
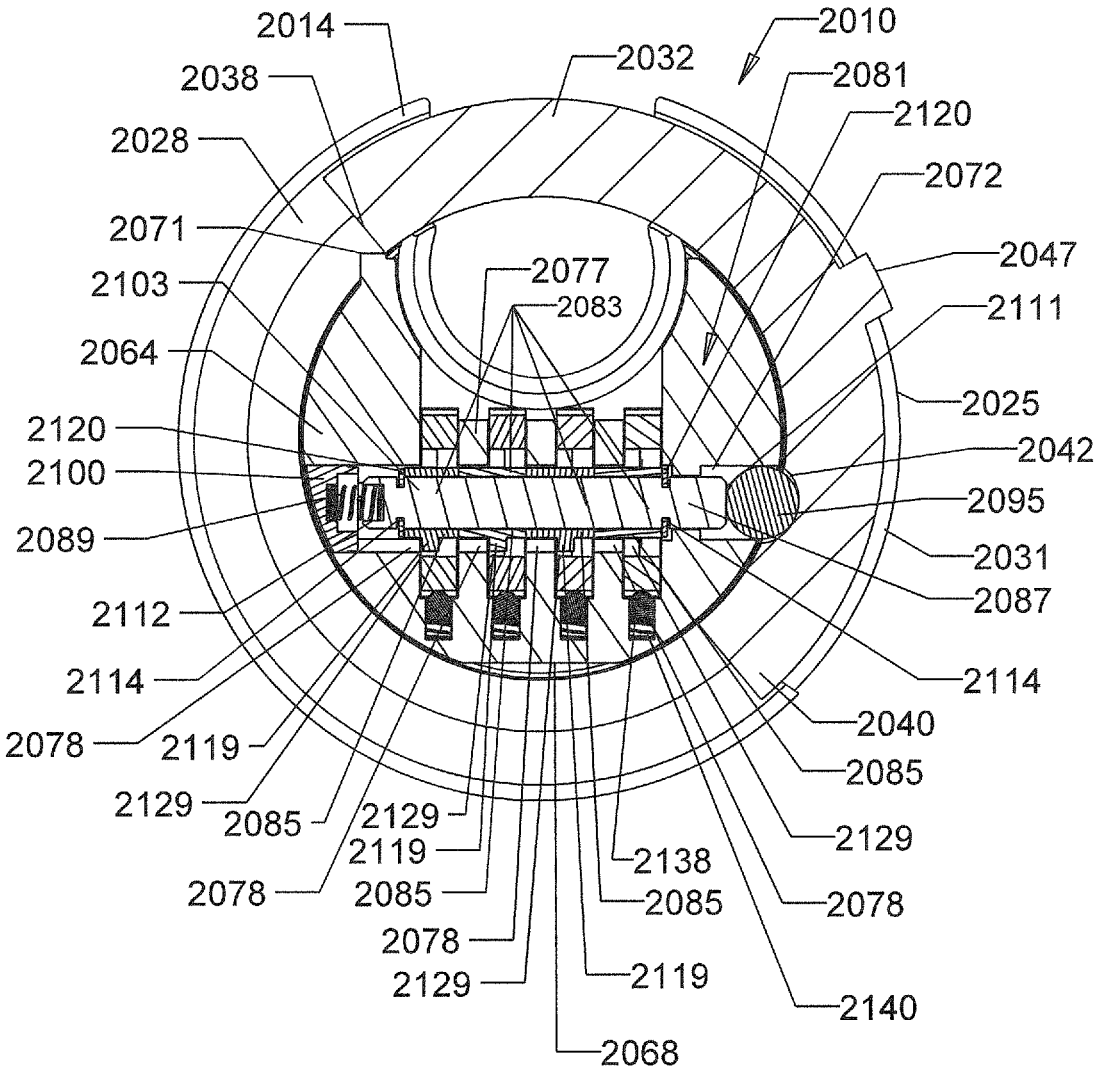
FIG. 23 is a cross-sectional view of the other exemplary embodiment of the combination disc padlock shown in FIGS. 22A and 22B, with the cross-section taken through the plane defined by the disc of the padlock and showing the shackle in the closed position.
Figure 24:
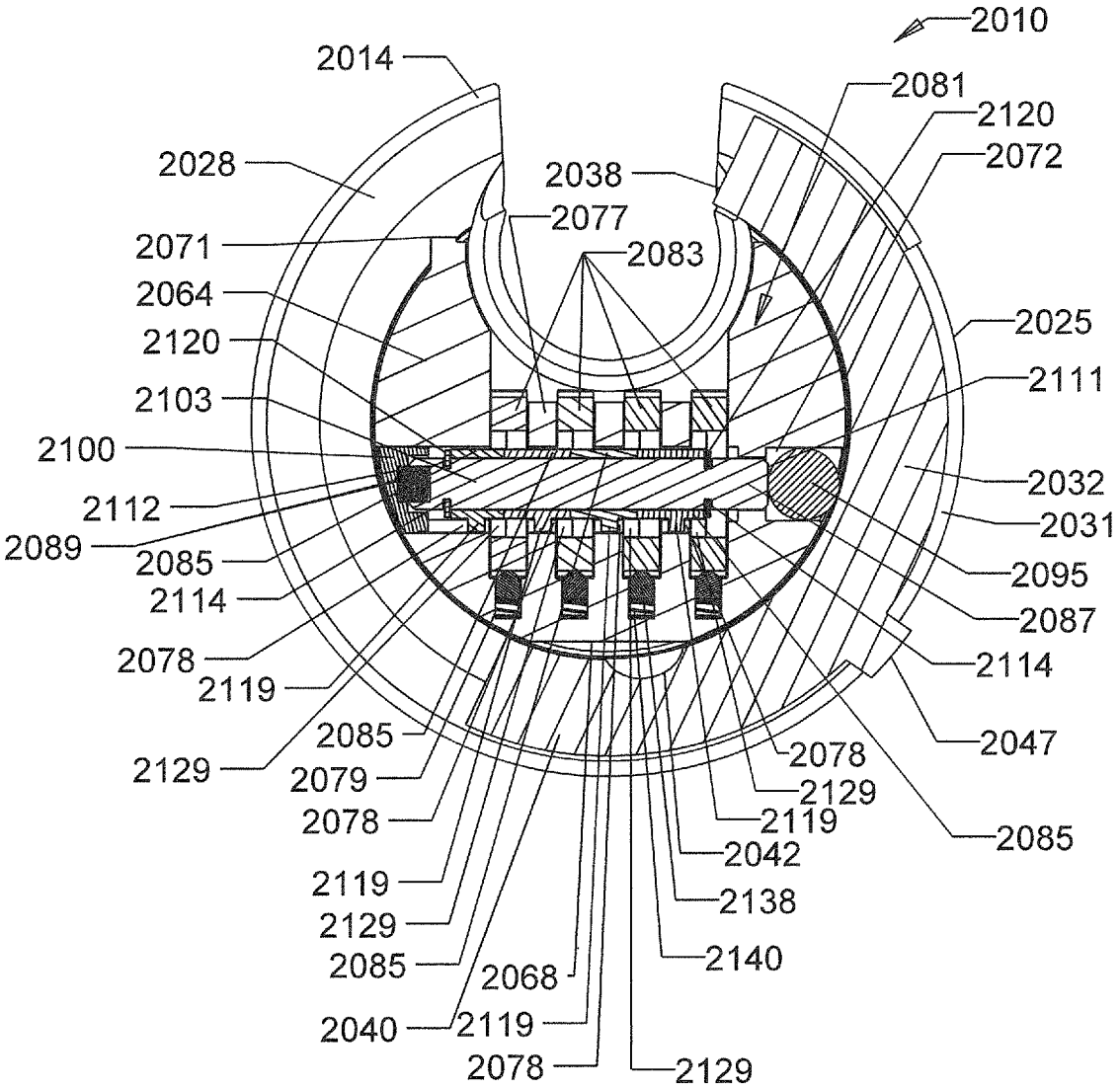
FIG. 24 is a cross-sectional view of the other exemplary embodiment of the combination disc padlock shown in FIGS. 22A and 22B, with the cross-section taken through the plane defined by the disc of the padlock, showing the shackle in the open position and the combination disc padlock in the unlocked position.
Figure 25:
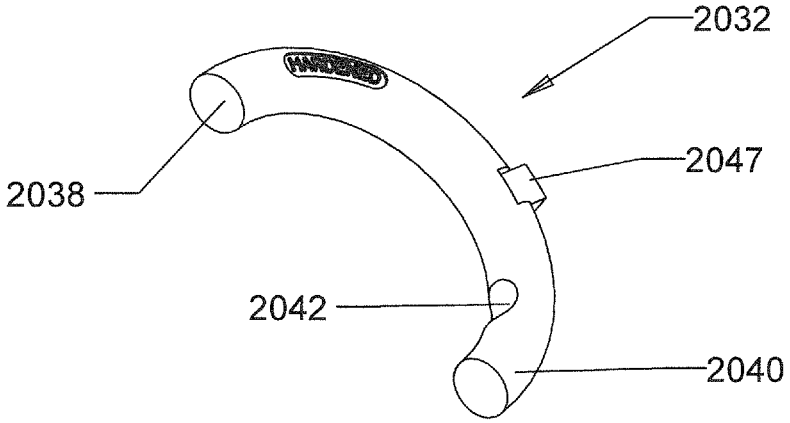
FIG. 25 is a perspective view of an exemplary embodiment of a shackle that may be used in the combination disc padlock according to the present invention.

Referring now to FIGS. 23-24, the combination disc padlock 2010 may also include a inner lock body 2064 positioned between the front housing member 2012 and the rear housing member 2014, and at least partially surrounded around its periphery by the substantially circular tunnel 2030 and the shackle 2032. The inner lock body 2064 has the same construction and components as the inner lock body 64 discussed above with respect to the first embodiment of the present invention. For example, the inner lock body 2064 also includes at least one flat surface 2068 along its periphery, a stopping edge 2071 protruding from its periphery, a ball receiving cavity 2072, at least one blocking wall 2077, at least one extending fin receiving slot 2078, and at least one cylindrical hole 2079 positioned adjacent to each blocking wall 2077. A combination code core locking mechanism 2081 may be formed from the inner lock body 2064, at least one dial 2083, at least one clutch 2085, a spindle 2087, a spindle spring 2089, a locking ball 2095 and a bottom sealed cap 2100. The components of the combination code core locking mechanism 2081 have the same and/or similar structure and/or function to the components of the combination code core locking mechanism 81 discussed above with respect to the first embodiment of the present invention. The components of the combination code core locking mechanism 2081 are also configured and interact in the same and/or similar manner to the components of the combination code core locking mechanism 81. For example, the locking ball 2095 may be positioned at least partially within the ball receiving cavity 2072 of the inner lock body 2064, and when the shackle 2032 is positioned in the closed positioned, as shown for example in FIG. 23, the ball receiving cavity 2072 is substantially aligned with the curved cutout 2042 formed in the shackle 2032. Similarly, the spindle 2087 may be positioned through the inner lock body 2064, and extend at least partially into the ball receiving cavity 2072 in order to come into contact with the locking ball 2095. The spindle 2087 may be formed from a substantially cylindrical body 2103 and include a face 2111 at one end and a hole 2112 formed in the other end. A pair of split-ring slots 2114 are formed in the substantially cylindrical body 2103 of the spindle 2087 between the face 2111 and the hole 2112.

In addition, the combination code core locking mechanism 2081 may also include the at least one clutch 2085 positioned around the substantially cylindrical body 2103 of the spindle 2087, and each of the at least one clutch 2085 may include one or more extended fins 2119, for example three, extending radially outward from the clutch 2085. The at least one clutch 2085 positioned around the substantially cylindrical body 2103 of the spindle 2087 may be held in place by a pair of split rings 2120 so that movement of the spindle 2087 along its longitudinal axis is transferred to the at least one clutch 2085. Similar to the first exemplary embodiment of the present invention, the combination code core locking mechanism 2081 may also include at least one dial 2083, which is operatively engaged with a clutch 2085 such that rotational movement of the dial 2083 is imparted to the clutch 2085. Each of the dials 2083 include a plurality of teeth 2129, which are configured to engage with at least one extended fin 2119 of the clutch 2085 permitting both the clutch 2085 and the dial 2083 to be configured to rotate about the spindle 2087. The combination code core locking mechanism 2081 of the combination disc padlock 2010 may also include a plurality of pins 2138, where each pin 2138 is positioned for operative engagement with a corresponding dial 2083. Each pin 2138 is also operatively coupled to a pin spring 2140 that is configured to urge each pin 2138 in a direction towards the dial 83 corresponding to the pin 2138. Each pin 2138 and pin spring 2140 are mounted in a cylindrical hole 2079 forming a receiving cavity in the inner lock body 2064 for each pin 2138 and pin spring 2140.

Referring now to FIGS. 23-24, the operation and use of the combination disc padlock 2010 according to the present invention will now be discussed. It is understood that the shackle 2032 of the padlock 2010 is moveable between a closed position, as shown for example in FIG. 23, and an open position, as shown for example in FIG. 24. It is further understood that the shackle 2032 may be positionable between the closed and open positions at any location between the closed and open positions. It is also understood that the combination code core locking mechanism 2081 is configured to have a locked configuration, as shown for example in FIG. 23, and an unlocked configuration, as shown for example in FIG. 24. It is further understood that even while the combination code core locking mechanism 2081 is in the unlocked configuration the shackle 2032 may still be in the closed position, since the extended projection 2047 may not yet have been actuated in order to move the shackle 2032 into the open position. However, it is understood that the shackle 2032 may not be moved into the open position unless the combination code core locking mechanism 2081 is placed in the unlocked configuration.

As discussed above with respect to the first embodiment of the present invention, when the dials 2083 are aligned in the correct code and/or combination for the combination code core locking mechanism 2081, the combination code core locking mechanism 2081 is in the unlocked configuration, and as a result the shackle 2032 can be turned clockwise in order to place the shackle 2032 into the open position. The extended projection 2047 provides a mechanism for turning the shackle 2032, and this exemplary embodiment illustrates that a button is not the only element that can be used as a mechanism for urging the shackle 2032 into the open and/or closed position. When the extended projection 2047 is moved in a clockwise direction along the arcuate channel 2031 when the combination code core locking mechanism 2081 is in the unlocked configuration the shackle 2032 may be placed in the open position. Conversely, when the extended projection 2047 is moved in a counter-clockwise direction along the arcuate channel 2031 the shackle 2032 may be placed in the closed position. It is understood that the arcuate movement of the extended projection 2047, and thereby the movement of the shackle 2032 is limited and/or restricted to movement of the extended projection 2047 within the arcuate channel 2031.

It is understood that operation and use, for example, locking and unlocking the combination disc padlock 2010, opening and closing the shackle 2032 and resetting the code and/or combination for the combination disc padlock 2010 may be performed in the same manner as discussed above with respect to the first exemplary embodiment of the present invention.

Referring now to FIGS. 26-29, in which a fourth exemplary embodiment of a combination disc padlock, generally indicated by reference numeral 3010, according to the present invention is shown. The combination disc padlock 3010 includes a front housing member 3012 and a rear housing member 3014, both of which are substantially disc shaped and are configured to contain at least some of the internal components of the combination disc padlock 2010. The front housing member 3012 and the rear housing member 3014 are also configured to be joined together in order to form a body portion 3015 of the combination disc padlock 3010. It is understood that while the front housing member 3012 and rear housing member 3014 are referred to as "front" and "rear," these terms are merely relative and do not limit the positioning of the combination disc padlock 3010 to any particular orientation. The front housing member 3012 includes a cutout slot 3017 formed in the perimeter thereof, at least one alignment bar 3022 positioned substantially adjacent to at least one dial receiving area 3023 and a front perimeter channel (not shown) extending around at least a portion of the perimeter of the front housing member 3012. The rear housing member 3014 also includes at least one dial receiving area (not shown) that may be positioned in substantial alignment with corresponding dial receiving areas 3023 of the front housing member 3012. The rear housing member 3014 may also include a cutout slot 3027 formed in the perimeter thereof, and positioned for alignment with the cutout slot 3017 of the front housing member 3012 when the rear housing member 3014 is joined together with the front housing member 3012. The rear housing member 2014 also includes a rear perimeter channel 3028 extending around at least a portion of the perimeter of the rear housing member 3014. The rear perimeter channel 3028 is positioned for alignment with the front perimeter channel (not shown) so that when the front housing member 3012 and rear housing member 3014 are joined together a substantially circular tunnel 3030 is formed in the combination disc padlock 3010. Furthermore, the cutout slot 3017 of the front housing member 3012 and the cutout slot 3027 of the rear housing member 3014 are positioned for alignment when the housing members are joined together in order to form an arcuate channel 3031 in the perimeter of the body portion 3015 of the combination disc padlock 3010. The front housing member 3012 and rear housing member 3014 forming the lock housing may be welded together after assembly in order to insure that the components of the combination disc padlock 3010 remain in place.

Figure 30A:
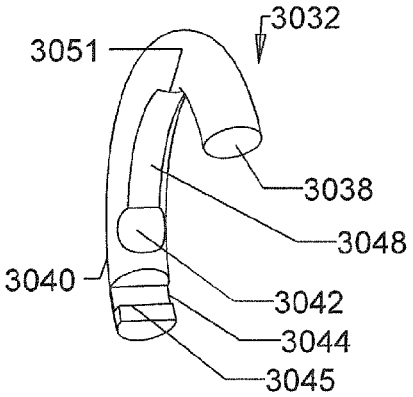
FIGS. 30A, 30B, 30C are perspective views of an exemplary embodiment of a shackle that maybe used with the combination disc padlock according to the present invention.
Figure 30B:
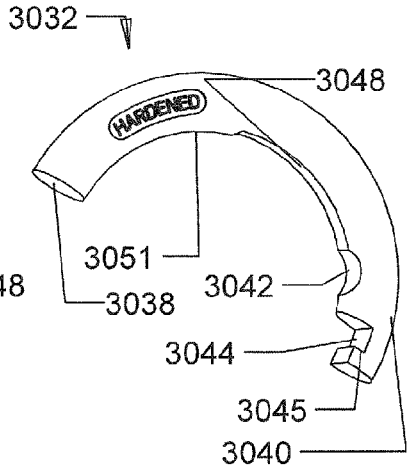
Figure 30C:
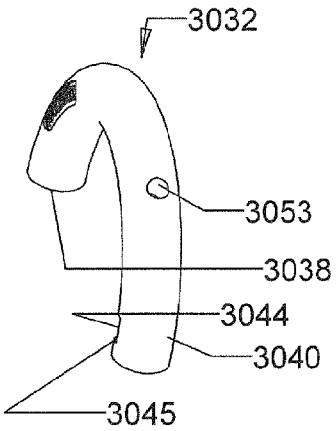
Figure 31:
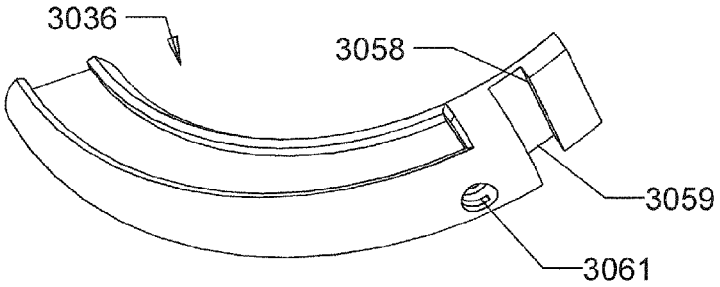
FIG. 31 is a perspective view of an exemplary embodiment of a lower shackle that maybe used with the combination disc padlock according to the present invention.
Figure 32:
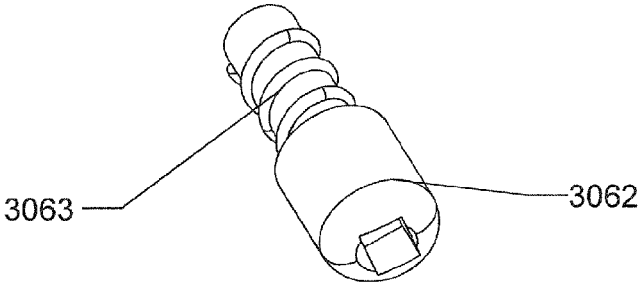
FIG. 32 is a perspective view of an exemplary embodiment of a screw button that maybe used with the combination disc padlock according to the present invention.

Still referring to FIGS. 26-29, the substantially circular tunnel 3030 of the combination disc padlock 3010 is configured and dimensioned to at least contain a shackle 3032 and a button portion 3036 operatively connected to the shackle 3032. The shackle 3032 and the button portion 3036 are configured for arcuate movement within the substantially circular tunnel 3030, and may be arcuate in shape. As shown in FIGS. 30A, 30B and 30C, the shackle 3032 includes an exposed end 3038 and an unexposed end 3040. Positioned on the shackle 3032 between the exposed end 3038 and the unexposed end 3040 is a curved cutout 3042. The unexposed end 3040 of the shackle 3032 may include a notch 3044 and tooth 3045 that are configured for engagement with the button portion 3036. The shackle 3032 may also include a recessed area 3048 positioned adjacent to the curved cutout 3042, and extending from the curved cutout 3042 to a full portion 3051 of the shackle 3032. The shackle 3032 may also include a hole 3053, which may be threaded, positioned on a surface of the shackle 3032 substantially opposite the curved cutout 3042. As shown in FIG. 31, the button portion 3036 includes a button tooth 3058 and a slot 3059. The button tooth 3058 and the slot 3059 are configured to engage with the notch 3044 and tooth 3045, respectively, on the shackle 3032. The button portion 3036 may also include a threaded hole 3061 that is dimensioned and configured to receive a screw button 3062 with a threaded region 3063, as shown in FIG. 32.

Figure 26:
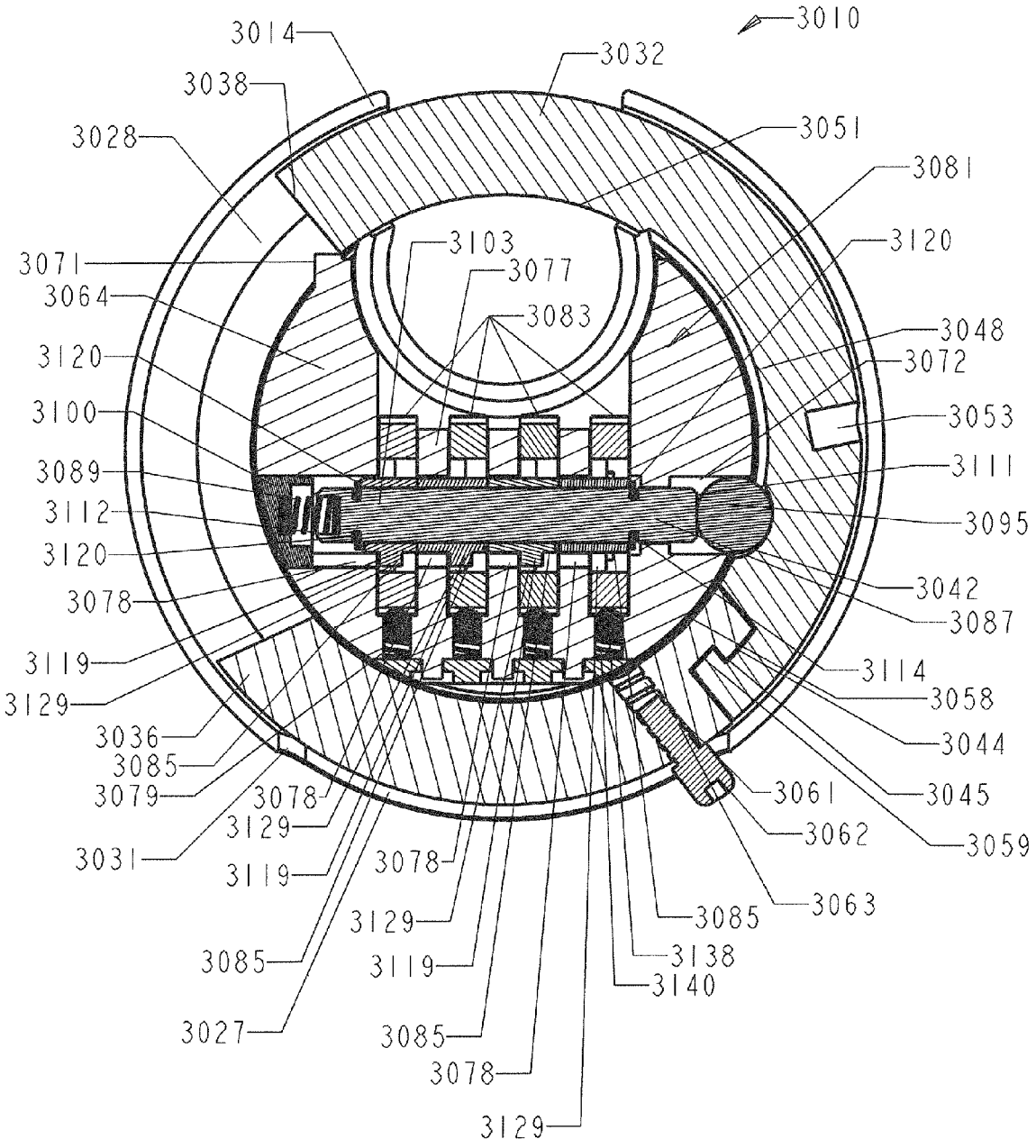
FIG. 26 is a cross-sectional view of another exemplary embodiment of a combination disc padlock according to the present invention, with the cross-section taken through the plane defined by the disc of the padlock and shown in the locked mode.
Figure 27:
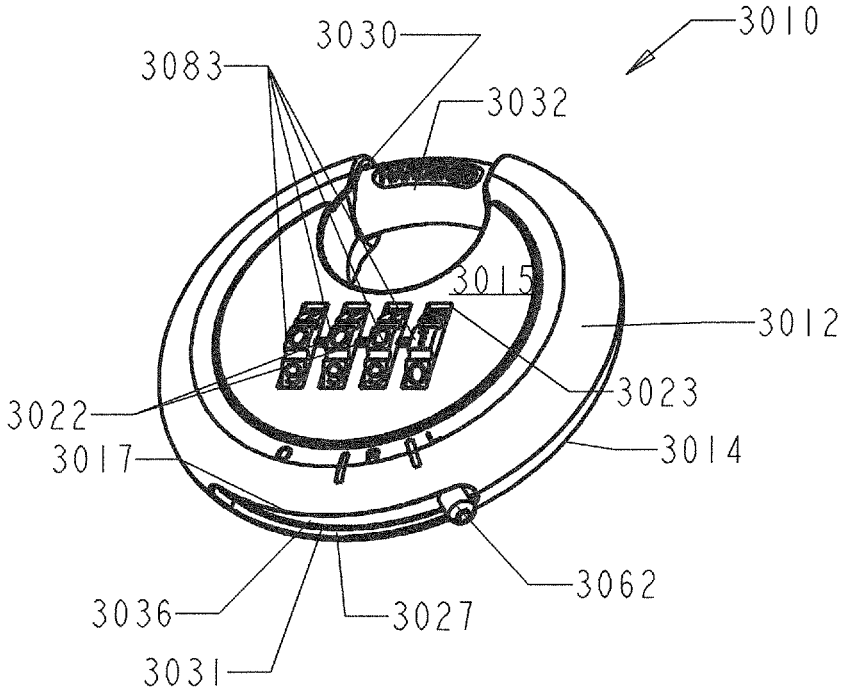
FIG. 27 is a front perspective view of the other exemplary embodiment of the combination disc padlock shown in FIG. 26.
Figure 28:
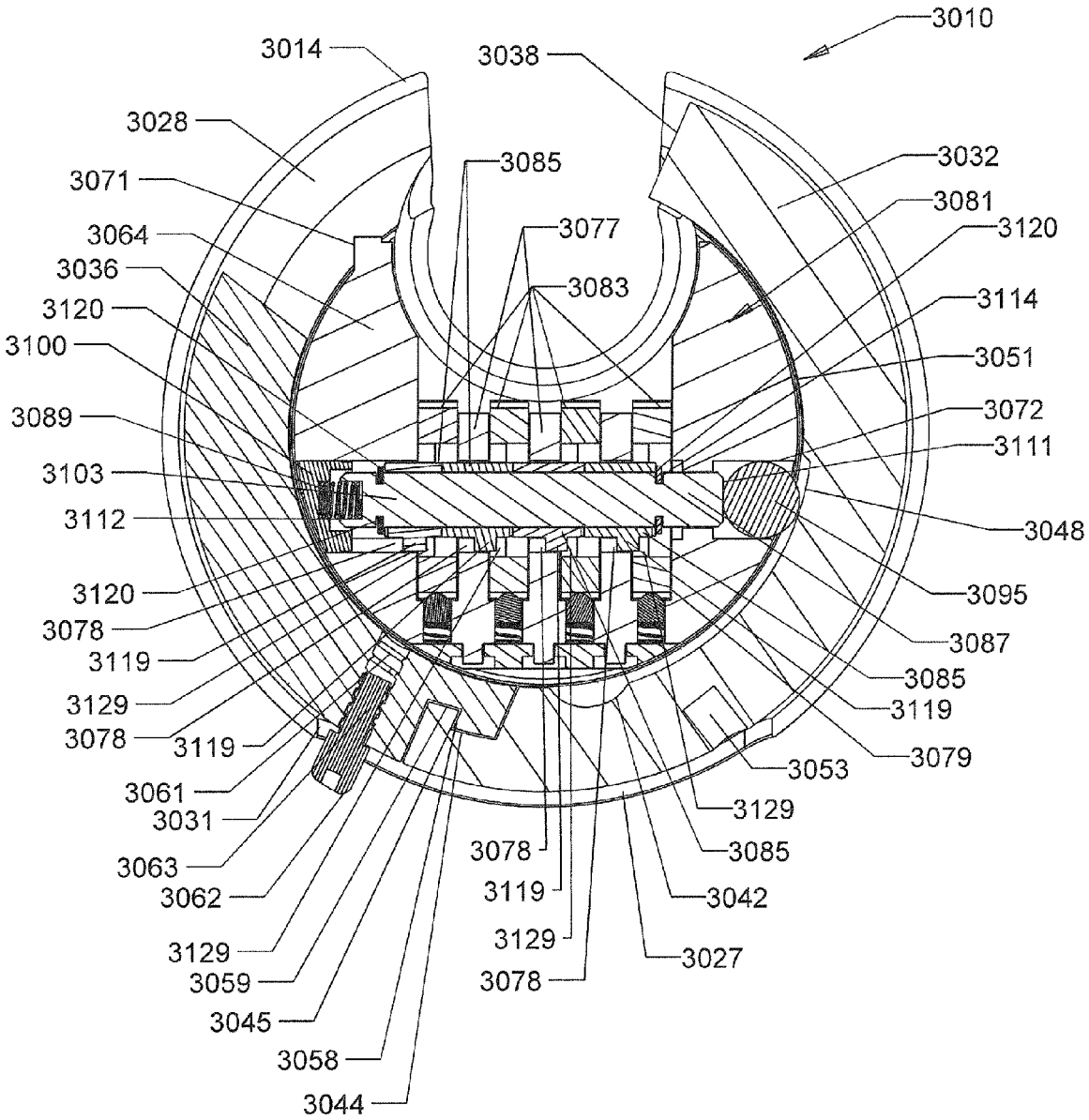
FIG. 28 is a cross-sectional view of the other exemplary embodiment of the combination disc padlock shown in FIG. 26, with the cross-section taken through the plane defined by the disc of the padlock and shown in the unlocked mode.
Figure 29:
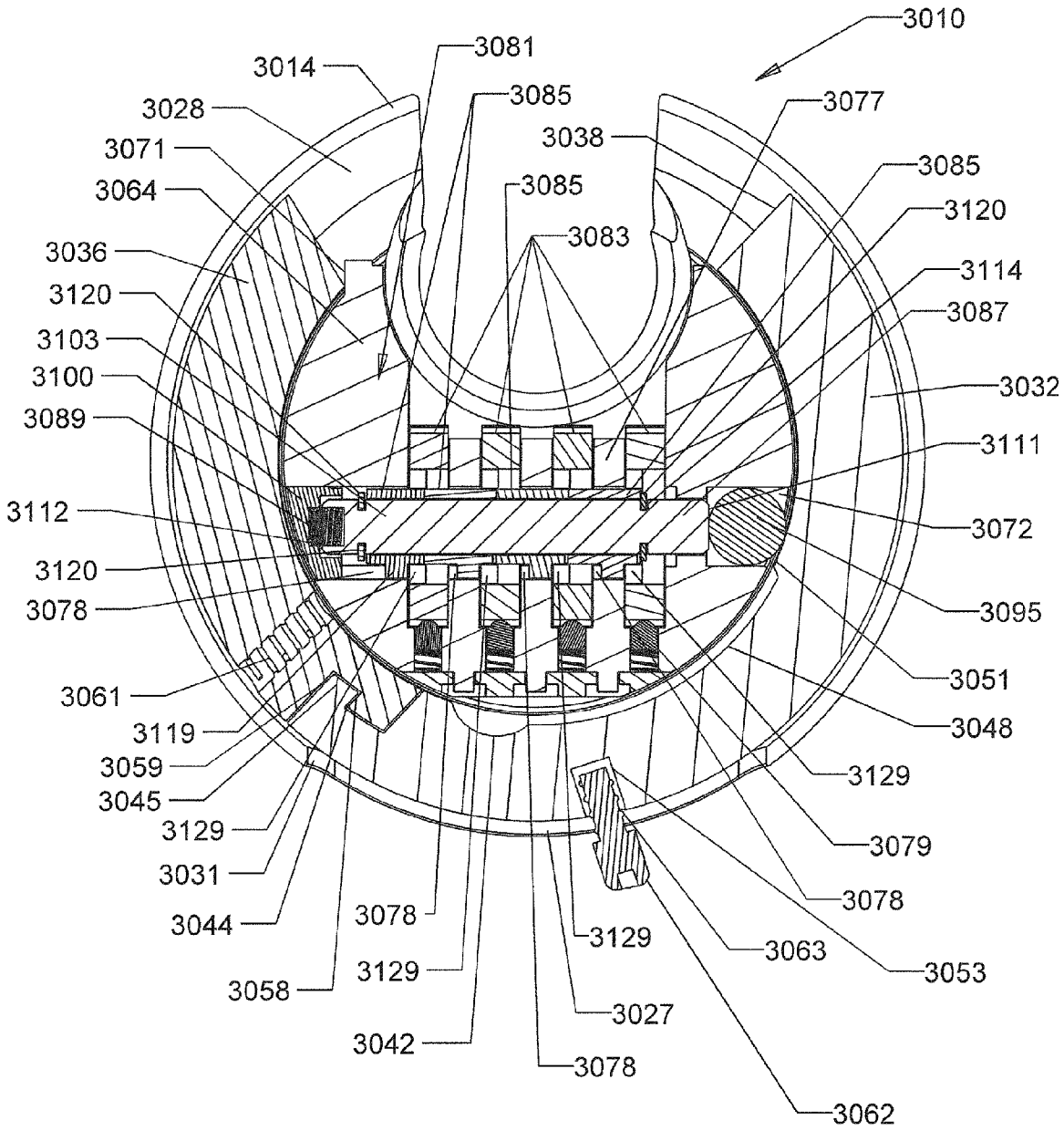
FIG. 29 is a cross-sectional view of the other exemplary embodiment of the combination disc padlock shown in FIG. 26, with the padlock is in the combination reset mode.

Referring now to FIGS. 26 and 28-29, the combination disc padlock 3010 may also include a inner lock body 3064 positioned between the front housing member 3012 and the rear housing member 3014, and at least partially surrounded around its periphery by the substantially circular tunnel 3030 and the shackle 3032. The inner lock body 3064 has the same construction and components as the inner lock body 64 discussed above with respect to the first exemplary embodiment of the present invention. For example, the inner lock body 3064 also includes a stopping edge 3071 protruding from its periphery, a ball receiving cavity 3072, at least one blocking wall 3077, at least one extending fin receiving slot 3078, and at least one cylindrical hole 3079 positioned adjacent to each blocking wall 3077. A combination code core locking mechanism 3081 may be formed from the inner lock body 3064, at least one dial 3083, at least one clutch 3085, a spindle 3087, a spindle spring 3089, a locking ball 3095 and a bottom sealed cap 3100. The components of the combination code core locking mechanism 3081 have the same and/or similar structure and/or function to the components of the combination code core locking mechanism 81 discussed above with respect to the first embodiment of the present invention. The components of the combination code core locking mechanism 3081 are also configured and interact in the same and/or similar manner to the components of the combination code core locking mechanism 81. For example, the spindle 3087 may be positioned through the inner lock body 3064, and extend at least partially into the ball receiving cavity 3072 in order to come into contact with the locking ball 3095. The spindle 3087 may be formed from a substantially cylindrical body 3103 and include a face 3111 at one end and a hole 3112 formed in the other end. A pair of split-ring slots 3114 are formed in the substantially cylindrical body 3103 of the spindle 3087 between the face 3111 and the hole 3112.

In addition, the combination code core locking mechanism 3081 may also include the at least one clutch 3085 positioned around the substantially cylindrical body 3103 of the spindle 3087, and each of the at least one clutch 3085 may include one or more extended fins 3119, for example three, extending radially outward from the clutch 3085. The at least one clutch 3085 positioned around the substantially cylindrical body 3103 of the spindle 3087 may be held in place by a pair of split rings 3120 so that movement of the spindle 3087 along its longitudinal axis is transferred to the at least one clutch 3085. Similar to the first exemplary embodiment of the present invention, the combination code core locking mechanism 3081 may also include at least one dial 3083, which is operatively engaged with a clutch 3085 such that rotational movement of the dial 3083 is imparted to the clutch 3085. Each of the dials 3083 include a plurality of teeth 3129, which are configured to engage with at least one extended fin 3119 of the clutch 3085 permitting both the clutch 3085 and the dial 3083 to be configured to rotate about the spindle 3087. The combination code core locking mechanism 3081 of the combination disc padlock 3010 may also include a plurality of pins 3138, where each pin 3138 is positioned for operative engagement with a corresponding dial 3083. Each pin 3138 is also operatively coupled to a pin spring 3140 that is configured to urge each pin 3138 in a direction towards the dial 83 corresponding to the pin 3138. Each pin 3138 and pin spring 3140 are mounted in a cylindrical hole 3079 forming a receiving cavity in the inner lock body 3064 for each pin 3138 and pin spring 3140.

Referring now to FIGS. 26 and 28-29, the operation and use of the combination disc padlock 3010 according to the present invention will now be discussed. It is understood that the shackle 3032 of the padlock 3010 is moveable between a closed position, as shown for example in FIG. 26, and an open position, as shown for example in FIG. 28. It is further understood that the shackle 3032 may be positionable between the closed and open positions at any location between the closed and open positions. It is also understood that the combination code core locking mechanism 3081 is configured to have a locked configuration, as shown for example in FIG. 26, and an unlocked configuration, as shown for example in FIG. 28. It is further understood that even while the combination code core locking mechanism 3081 is in the unlocked configuration the shackle 3032 may still be in the closed position, since the screw button 3062 may not yet have been actuated in order to move the shackle 3032 into the open position. However, it is understood that the shackle 3032 may not be moved into the open position unless the combination code core locking mechanism 3081 is placed in the unlocked configuration.

As discussed above with respect to the first embodiment of the present invention, when the dials 3083 are aligned in the correct code and/or combination for the combination code core locking mechanism 3081, the combination code core locking mechanism 3081 is in the unlocked configuration, and as a result the shackle 3032 can be turned clockwise in order to place the shackle 3032 into the open position. The screw button 3062 provides a mechanism for turning the shackle 3032. When the screw button 3062 is moved in a clockwise direction along the arcuate channel 3031 when the combination code core locking mechanism 3081 is in the unlocked configuration, the shackle 3032 may be placed in the open position. Conversely, when the screw button 3062 is moved in a counter-clockwise direction along the arcuate channel 3031 the shackle 3032 may be placed in the closed position. It is understood that the arcuate movement of the screw button 3062, and thereby the movement of the shackle 3032 is limited and/or restricted to movement of the screw button 3062 within the arcuate channel 3031.

It is understood that operation and use, for example, locking and unlocking the combination disc padlock 3010 and opening and closing the shackle 3032 may be performed in the same manner as discussed above with respect to the first exemplary embodiment of the present invention. However, the combination disc padlock 3010 includes a reset mechanism that effectively prevents accidental changing of the combination code when the shackle 3032 is in the open position and the combination disc padlock 3010 in the unlocked configuration. This reset mechanism includes the screw button 3062 as discussed further below. In order to reset the code and/or combination for the combination disc padlock 3010, all of the dials 3083 must be aligned in the correct code and/or combination, and then the screw button 3062 may be moved in a clockwise direction along the arcuate channel 3031. The screw button 3062 is configured so as to be rotated in order to withdraw the screw button 3062 from the threaded hole 3061 of the button portion 3036. When this is accomplished, the screw button 3061 may be inserted into the hole 3053 of the shackle 3032. In this configuration, the screw button 3062 is no longer prohibited from further clockwise movement by an end of the arcuate channel 3031, and therefore the shackle 3032 may be further moved in the clockwise direction as seen in FIG. 29.

In the configuration shown in FIG. 29, the locking ball 3095 is no longer positioned within the recessed area 3048 of the shackle 3032, and is instead aligned with the full portion 3051 of the shackle 3032. The full portion 3051 thereby urges the locking ball 3095 further in a direction away from the shackle 3032, which in turn moves the spindle 3087 further away from the shackle 3032 in a direction along its longitudinal axis. This further movement of the spindle 3087 also causes the extended fins 3119 of the clutches 3085 to become completely disengaged from the teeth 3129 of the dials 3083. When in this configuration, the dials 3083 are thereby allowed to rotate, while clutches 3085 will not move, and therefore the he dials 3083 can be rotated so as to either reset and/or reconfigure the code and/or combination that may be used to unlock the combination disc padlock 3010. Therefore, as long as the screw button 3062 is positioned within the threaded hole 3061 the code and/or combination for the combination disc padlock 3010 may not be accidentally reset and/or reconfigured.

It will thus be seen that the objects set forth above, among those made apparent from the preceding description, are efficiently attained and, since certain changes may be made in the above article without departing from the scope of this invention, it is intended that all matter contained in this disclosure or shown in the accompanying drawings, shall be interpreted, as illustrative and not in a limiting sense. It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention. Numerous modifications and alternative arrangements may be devised by those skilled in the art without departing from the scope of the present invention.

What is claimed is:

1. A combination disc padlock comprising:

a housing having a disc shape with a perimeter and comprising a slot formed therein along a portion of the perimeter of the housing;

a shackle positioned within a portion of the housing and movable between an open position and a closed position, the shackle having a curved shape with a first end positioned within the housing and a second end which can be exposed from the housing when the combination disc padlock is in an unlocked configuration and the shackle is in the open position;

a combination code core locking mechanism comprising a lock body, a spindle positioned within the lock body, at least one clutch positioned concentrically with the spindle, at least one dial operatively engaged with each of the at least one clutches, and a locking ball operatively connected to the spindle; and an actuation mechanism operatively coupled to the shackle, and configured to permit movement of the shackle between the open position and the closed position when the combination disc padlock is in the unlocked configuration, and comprising a button portion operatively engaged with the shackle and having a threaded hole, and a screw button threadenly engaged with the threaded hole of the button portion;

wherein the combination code core locking mechanism is configured to operate the combination disc padlock between the unlocked configuration and a locked configuration, and configured to control movement of the shackle between the open position and the closed position;

wherein the screw button is configured to extend through the slot formed in the housing so as to allow the shackle to be turned between the open position and the closed position when the combination disc padlock is in the unlocked configuration;

wherein the shackle further comprises a reset hole positioned therein, a curved cutout dimensioned to receive at least a portion of the locking ball and a recessed area positioned adjacent to the curved cutout;

wherein when the combination disc padlock is in the locked configuration and the shackle is in the closed position at least the portion of the locking ball is positioned in the curved cutout of the shackle;

wherein when the combination disc padlock is in the unlocked configuration and the shackle is in the open position at least the portion of the locking ball is positioned in the recessed area of the shackle, and the reset hole is exposed in the slot formed along the perimeter of the housing; and wherein the reset hole is dimensioned to receive the screw button in order to permit further actuation of the shackle from the open position to a reset position in which at least the portion of the locking ball is not positioned in the recessed area of the shackle.

2. The combination disc padlock according to claim 1, wherein the actuation mechanism comprises a button portion operatively connected to the shackle and comprising a button portion protrusion configured to facilitate operation of the shackle between the open position and the closed position when the combination disc padlock is in the unlocked configuration;

wherein the slot is dimensioned to receive the button portion protrusion and have at least a part of the button portion protrusion extend from the housing; and wherein the slot is further configured to act as guide for the button portion protrusion such that movement of the button portion protrusion is substantially restricted to the slot in the housing.

3. The combination disc padlock according to claim 1, wherein the actuation mechanism comprises an extended projection extending from the shackle and configured to extend through the slot formed in the housing so as to allow for circular movement of the shackle along the perimeter of the housing between the open position and the closed position when the combination disc padlock is in the unlocked configuration.

4. The combination disc padlock according to claim 3, wherein the housing comprises a front housing member and a rear housing member, and wherein the slot is formed in at least one of the front housing member or the rear housing member.

5. The combination disc padlock according to claim 1, wherein the actuation mechanism comprises a gripping area formed on the shackle, and wherein the gripping area is configured to facilitate operation of the shackle between the open position and the closed position when the combination disc padlock is in the unlocked configuration.

6. The combination disc padlock according to claim 1, wherein each clutch of the at least one clutches comprises at least one extended fin, and the lock body comprises at least one extended fin receiving slot dimensioned to receive a corresponding extended fin of one of the clutches so that when all of the extended fin receiving slots and extended fins are aligned with each other, the spindle can be moved in a direction away from the locking ball thereby permitting the locking ball to be pushed by a curved cutout formed in the shackle such that the locking ball is forced to move out of the curved cutout and thereby permitting movement of the shackle into the open position.

7. The combination disc padlock according to claim 1, wherein the lock body comprises a stopping edge configured to control movement of the shackle when the shackle is turned from the opened position to the closed position.

8. The combination disc padlock according to claim 1, wherein a combination code for the combination code core locking mechanism can be reset or reconfigured when the shackle is in the open position;

wherein when the shackle is in the open position each of the at least one dials are disengaged from each of the at least one clutches so that each of the at least one dials may be rotated without also causing rotation of each of the at least one clutches; and wherein when the shackle is moved back into the closed position each of the at least one clutches re-operatively engages with each of the at least one dials resulting in the combination code for the combination code core locking mechanism being reset or reconfigured.

9. The combination disc padlock according to claim 1, wherein a combination code for the combination code core locking mechanism can be reset or reconfigured when the shackle is in the reset position;

wherein when the shackle is in the reset position each of the at least one dials are disengaged from each of the at least one clutches so that each of the at least one dials may be rotated without also causing rotation of each of the at least one clutches; and wherein when the shackle is moved back into the open positioned or closed position each of the at least one clutches re-operatively engages with each of the at least one dials resulting in the combination code for the combination code core locking mechanism being reset or reconfigured.

10. The combination disc padlock according to claim 1, wherein each of the at least one clutches comprises at least one extended fin, and each of the at least one dials comprises at least one tooth;

wherein each of the at least one clutches is operatively engaged with each of the at least one dials through engagement of the at least one extended fin with the at least one tooth;

wherein when the shackle is in the closed position or open position the at least one extended fin is operatively engaged with the at least one tooth and rotation of the at least one dials is imparted to the at least one clutches; and wherein when the shackle is in the reset position the at least one extended fin is disengaged with the at least one tooth and rotation of the at least one dials is not imparted to the at least one clutches.

11. The combination disc padlock according to claim 1, wherein the shackle is configured for circular movement of along the perimeter of the housing between the open position and the closed position when the combination disc padlock is in the unlocked configuration.

* * * * *